US005305994A

United States Patent [19]

Matsui et al.

[11] Patent Number: 5,305,994

[45] Date of Patent: Apr. 26, 1994

[54] SORTER WITH ROTARY SPIRALS AND GUIDE RAILS

[75] Inventors: Toshikazu Matsui, Kishiwada; Takatoshi Nishimura, Hirakata; Kenichi Honda, Kawasaki; Shoichiro Tajima, Sagamihara; Keiichi Asano, Tokyo; Hiroyuki Nagai, Toyonaka; Nobukazu Ootsuka, Kashiba, all of Japan

[73] Assignee: Mita Industrial Co., Ltd., Osaka, Japan

[21] Appl. No.: 912,460

[22] Filed: Jul. 13, 1992

[30] Foreign Application Priority Data

| | | | |
|---|---|---|---|
| Jul. 16, 1991 | [JP] | Japan | 3-175282 |
| Nov. 20, 1991 | [JP] | Japan | 3-304923 |
| Nov. 26, 1991 | [JP] | Japan | 3-311055 |

[51] Int. Cl.[5] ..... B65H 39/10; B65H 39/05; G03G 21/00

[52] U.S. Cl. ..... 270/58; 271/292; 271/294; 355/323

[58] Field of Search ..... 270/58, 53; 325/323; 271/292, 293, 294

[56] References Cited

U.S. PATENT DOCUMENTS

| | | | |
|---|---|---|---|
| 3,035,832 | 5/1962 | Bassett | 270/58 |
| 4,083,550 | 4/1978 | Pal | 270/58 X |
| 4,946,152 | 8/1990 | Ishikawa et al. | 270/58 X |
| 5,035,412 | 7/1991 | Hiroi et al. | 270/53 |
| 5,060,922 | 10/1991 | Shibusawa et al. | 270/58 X |
| 5,100,119 | 3/1992 | Komada et al. | 270/58 X |
| 5,112,035 | 5/1992 | Yamamoto et al. | 270/53 |
| 5,152,511 | 10/1992 | Shido et al. | 270/53 |
| 5,169,134 | 12/1992 | Ishiguro et al. | 270/58 X |

*Primary Examiner*—Edward K. Look
*Assistant Examiner*—John Ryznic
*Attorney, Agent, or Firm*—Jordan and Hamburg

[57] ABSTRACT

A sorter includes a sheet processing device, a plurality of bin trays arranged in a vertical direction, each bin tray having a specified width and length and adapted for bearing a sheet, shifting means for shifting the plurality of bin trays in the vertical direction, and moving means for moving the bin tray in a predetermined position in a lengthwise direction of the bin tray so that the sheet on the bin tray is processed by the sheet processing device. The bin tray can be moved to a position where sheet processing is to be applied by the sheet processing device.

10 Claims, 31 Drawing Sheets

SORTER WITH ROTARY SPIRALS AND GUIDE RAILS

BACKGROUND OF THE INVENTION AND RELATED ART STATEMENT

This invention relates to a sorter in which pins secured to and projecting horizontally outwards from opposite sides of bin trays are engaged in spiral guide surfaces defined in upstanding cylinders and a stack of bin trays are shifted upwards and downwards by drivingly rotating the cylinders.

Conventionally, there have been known sorters having the following construction. A spiral groove is defined on the surface of each of two upstanding cylinders arranged sideways. Pins secured to opposite sides of a plurality of bin trays disposed between the two cylinders are respectively engaged with these grooves. The cylinders are rotated by means of a motor, and thereby the bin trays are shifted upwards or downwards by causing the pins to slide relatively along guide surfaces formed by the grooves.

There have also known sorters provided with a sheet processing device including a stapler and a punch. In the sorters provided with the sheet processing device, a notch is formed in each rear end portion of a plurality of bin trays, and processing is applied to sheets placed on a given bin tray by moving the sheet processing device up to the notch of this bin tray.

In the sorter provided with the movable sheet processing device, it is required that the sheet processing device be moved to the bin tray bearing the sheets to be processed. However, since the sheet processing device is relatively heavy, it is required to improve rigidity of a mechanism for moving the sheet processing device and to increase power of a motor for driving the moving mechanism. These requirements have resulted in a complicated construction of the sheet processing device.

In order to solve the above problem, it is preferable to move the relatively light-weighted bin tray toward the sheet processing device. However, there has existed no such sorter provided with a mechanism for moving the bin tray, and accordingly it is necessary to consider a specific construction for the bin moving mechanism.

This bin moving mechanism necessitates a construction for disengaging pins of the bin tray bearing sheets to be processed from the grooves of the cylinders and moving the same toward the sheet processing device along guide members. In this case, it is necessary to smoothly transfer the pins of the bin tray from the grooves of the cylinders to the guide members. Unless otherwise, problems will occur such as misalignment of sheets placed on the bin tray.

On the other hand, the inertial force is acting on the cylinders and a rotatable shaft of a motor for rotating the cylinders. Accordingly, even if the braking force is applied to the rotating cylinders, the cylinders still rotate to some degree. Further, a rotating amount of the cylinders after application of the braking force due to the inertial force varies according to the weight of copy sheets placed on the bin trays. A drive transmission mechanism including gears and a timing belt for transmitting the torque of the motor to the cylinders are invariably associated with backlash. In order to accurately stop rotation of the cylinders in a predetermined position where, for example, the pins of the bin tray are smoothly transferable to the guide members, it is necessary to eliminate influence of the inertial force and backlash of the drive transmission mechanism.

Moreover, in the above sorter, the frictional resistance acts between the pins and grooves and between the pins and guide members. The frictional resistance particularly increases in the case where the bin trays are shifted upwards or the weight of the copy sheets on the bin trays are heavy. Such increased frictional resistance becomes a hindrance to smooth sliding of the bin tray and also produces frictional sounds. Further, the frictional resistance gives an increased burden on the motor for driving the cylinders, and abrades the pins and grooves. Accordingly, it is necessary to reduce the frictional resistance.

SUMMARY OF THE INVENTION

It is an object of the invention to provide a sorter which have overcome the above problems.

Accordingly, a sorter of the invention comprises a plurality of bin trays arranged in a vertical direction, each bin tray having a specified width and length and adapted for bearing a sheet, shifting means for shifting the plurality of bin trays in the vertical direction, and moving means for moving the bin tray in a predetermined position in a lengthwise direction of the bin tray. Also, the sorter may be further provided with a sheet processing device for applying sheet processing to the sheet at a predetermined portion. The moving means may be made to move the bin tray to a position where the sheet processing device applies sheet processing to the sheet on the bin tray.

Further, the shifting means may be constructed by a pair of rotatable upstanding cylinders arranged on opposite sides of the plurality of bin trays, each cylinder being formed with a guide surface spirally extending on a surface of the cylinder, a pair of pins horizontally projecting from the opposite sides of each bin tray and slidable on the guide surface, and driving means for rotating the pair of cylinders, whereby the pins slide on the guide surface in accordance with rotation of the cylinders so as to shift the plurality of bin trays in the vertical direction.

Further, the shifting means may be constructed by detector means for detecting the rotating amount of the cylinders, and controller means responsive to the detector means for controlling the driving means so that a desired one of the plurality of bin trays reaches the predetermined position.

Further, the moving means may be provided with disengaging means for disengaging the bin tray from the shifting means.

Further, the moving means may be constructed by a guide member having a slide surface inclined at an angle greater than the inclination of the spiral guide surface with respect to an axial direction of the cylinders. The spiral guide surface is formed with a flank having the same inclination as the slide surface and coming in alignment with the slide surface for each turn of the cylinders.

Further, the controller means may be made of first memory means for storing a stopping position at which the cylinders are stopped, second memory means for storing a braking position at which application of braking force to the cylinders is started, discriminator means for discriminating whether the cylinders are stopped at the stopping position, and a controlling portion responsive to the discriminator means for controlling the driving means so as to rotate the cylinders to the stopping position.

Further, the pins of the bin trays may be each provided with a roller rollable on the guide surface.

With the above constructions, the bin tray is shifted to the predetermined position by the shifting means and is moved therefrom in the lengthwise direction of the bin tray. Further, the sorter is provided with the sheet processing device. The moving means moves the bin tray in the predetermined position to a position where sheet processing is to be applied by the sheet processing device. Accordingly, the bin tray can be moved to the sheet processing position while a sheet processor is made to stay in a specified position on the sheet processing device, thus simplifying the construction of the sheet processing device. Especially, the construction of a mechanism for moving a sheet processor can be simplified.

Further, the bin tray is disengaged from the shifting means by the disengaging means. Accordingly, sheet processing can be performed in a position apart from the shifting means.

Further, the bin tray is moved to the slide surface of the guide member from the flank alignable with the slide surface. Accordingly, the bin tray can be smoothly transferred to the slide surface, thereby eliminating the likelihood that sheets on the bin tray become misaligned when the bin tray is transferred to the guide member from the shifting means.

Further, the pins are each provided with rollers. Consequently, the pins slide on the guide surface with less frictional sounds.

These and other objects, features and advantages of the present invention will become more apparent upon a reading of the following detailed description and accompanying drawings.

DETAILED DESCRIPTION OF PREFERRED EMBODIMENTS OF THE INVENTION

An image forming apparatus provided with a first sorter in accordance with the invention will be described with reference to the accompanying drawings.

Figure 30:
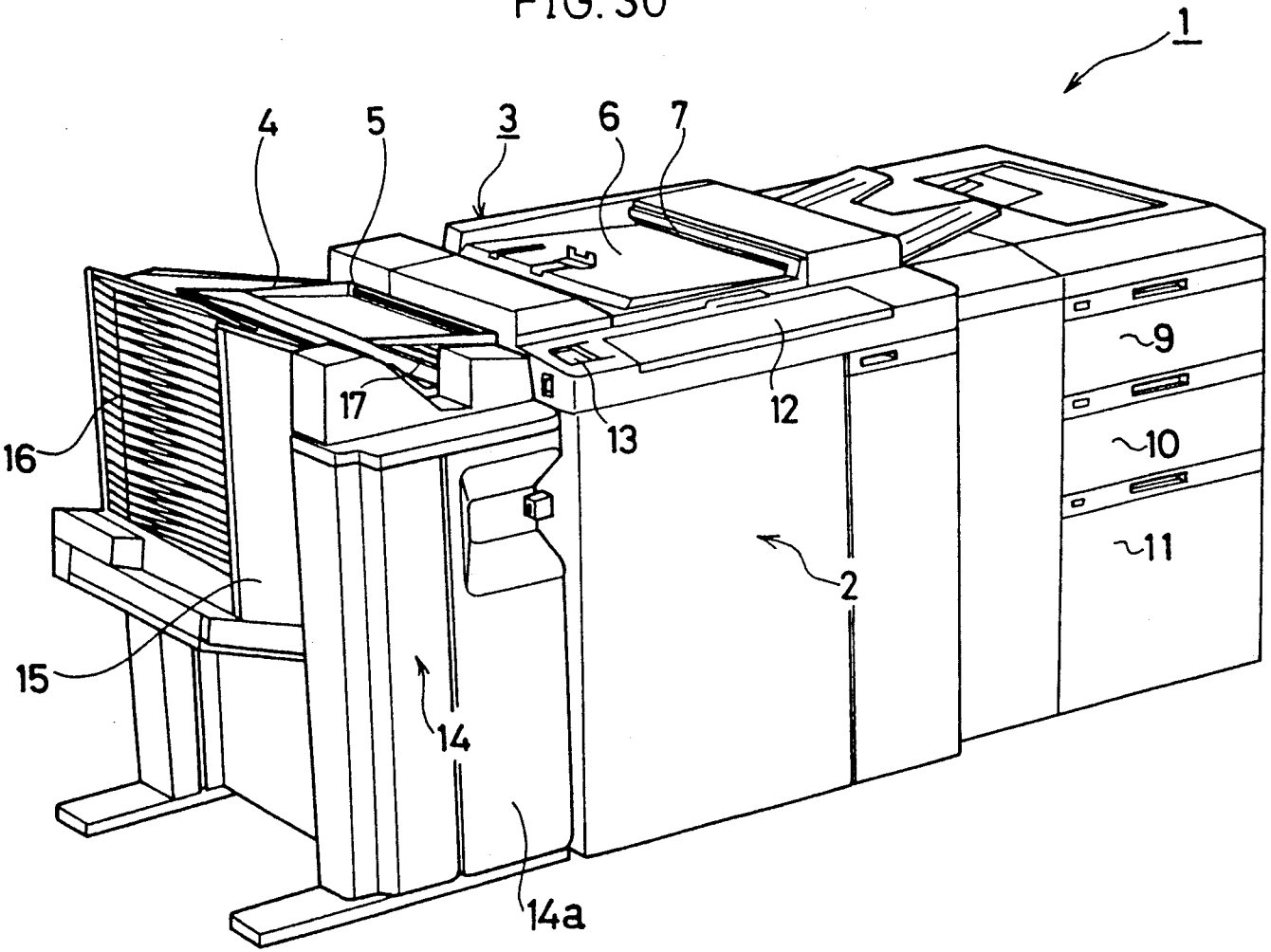
FIG. 30 is a perspective view showing an entire construction of an image forming apparatus into which a sorting unit of the invention is incorporated.

FIG. 30 is a perspective view showing an entire exterior of an image forming apparatus 1. The apparatus 1 is provided with an image forming unit 2 including an imaging assembly for forming an image on a copy sheet, and a sheet handling unit 14 including a sorter for sorting copy sheets discharged from the image forming unit 2 and a sheet processing device for applying mechanical processing such as punching and stapling to a sorted set of copy sheets.

In a center portion of an upper surface of the image forming unit 2 is placed an unillustrated document platen. The image forming unit 2 is internally provided with an optical system for optically scanning and exposing a document image, imaging assembly including a photosensitive drum and peripheral devices thereof for forming an image, transport assembly for transporting a copy sheet and the like.

Above the image forming unit 2 is arranged an automatic document feeder for feeding documents one by one automatically. The document feeder 3 is provided with a document holding tray 4, insertion opening 5, document transport assembly 6, and document discharge tray 7. Documents placed on the document holding tray 4 are automatically fed one by one through the insertion opening 5 and transported to a specified position on the document platen by the transport assembly 6. The document has its transport temporarily stopped at the specified position, and then discharged onto the discharge tray 7 after a copying operation.

An operation panel 12 is provided at a front upper side of the image forming unit 2. The operation panel 12 includes various switches such as a copy start switch and switches for designating the number of copies to be made from the same document, and various displays. To the left of the operation panel 12 in the drawing of FIG. 30 is provided a selection key panel 13 including keys for selecting desired processings to be carried out in the sheet handling unit 14. With the use of the selection key panel 13, an operator is allowed to designate sorting and necessary sheet processing such as punching and stapling.

Further, at the right side of the image forming unit 2 are provided cabinets 9, 10, and 11 which are designed to contain copy sheets therein. Variously sized copy sheets are allowed to be set in these cabinets.

A document to be copied is either automatically or manually placed in the specified position on the document platen, and has an image thereof optically scanned and exposed by the optical system. An electrostatic latent image formed on the surface of the photosensitive drum as a result of an exposure operation is developed into a toner image in the imaging assembly. The developed document image is transferred to a copy sheet fed from one of the cabinets 9 to 11. After having transferred document image fixed thereto, the copy sheet is discharged to the sheet handling unit 14.

At an upper portion of the sheet handling unit 14 is formed a discharge tray 17. The handling unit 14 is internally provided with a sorter 15 for shorting copy sheets discharged from the image forming unit 2 and an automatic sheet processing device 30 (not shown in FIG. 30) to be described later for applying mechanical processing such as punching and stapling to a set of copy sheets (hereinafter referred to as a copy sheet set). The sorter 15 is provided below the discharge tray 17 and includes a plurality of vertically arranged bin trays 16. Two adjacent bin trays are spaced apart by a specified distance. The copy sheets discharged from the image forming unit 2 are sequentially discharged to the plurality of bin trays 16 when to be sorted, and are discharged to the discharge tray 17 when not to be sorted.

Figure 1:
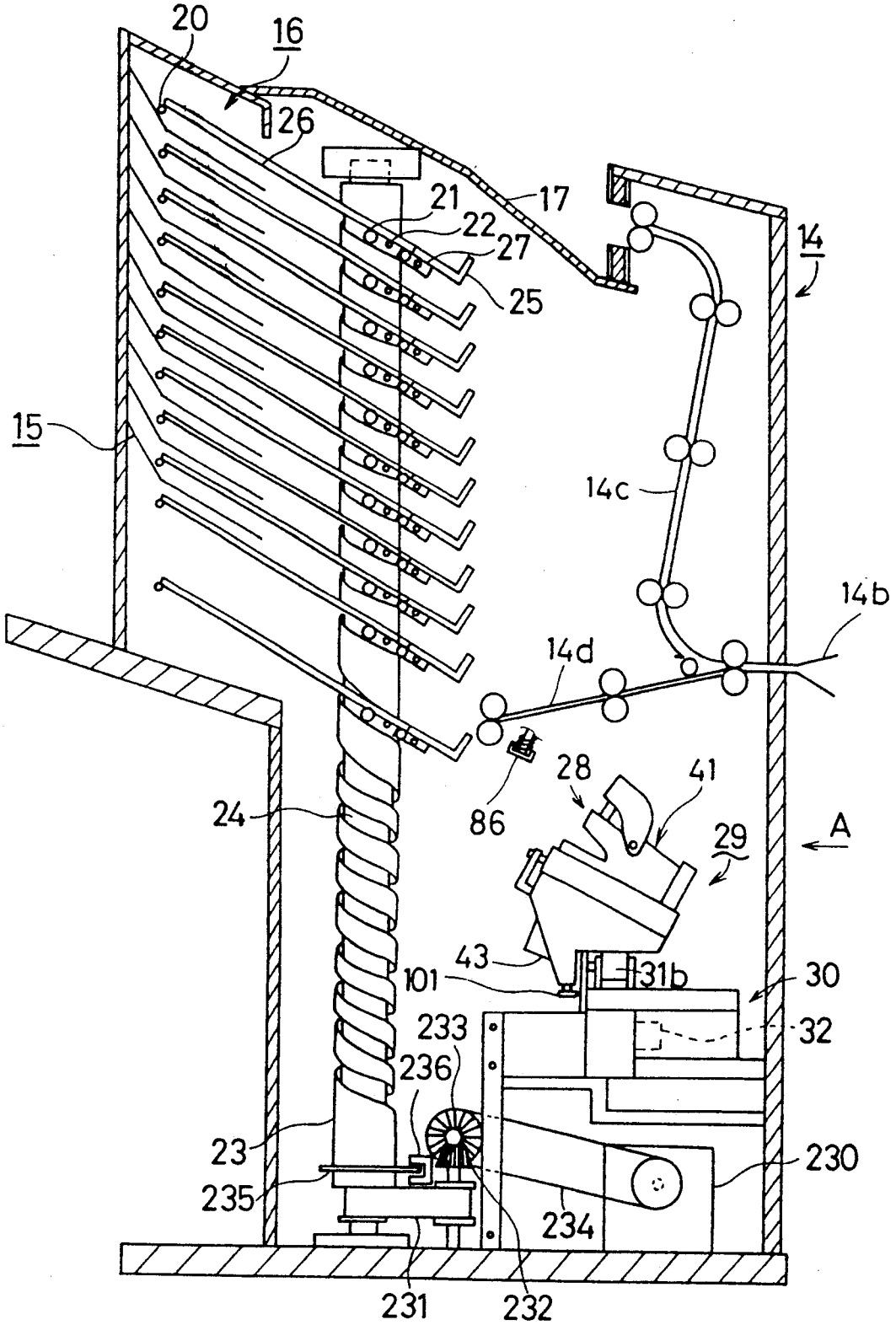
FIG. 1 is a longitudinal sectional view showing an interior construction of a sorting unit embodying the invention.

Next, an interior construction of the sheet handling unit 14 will be described. FIG. 1 is a longitudinal sectional view showing the interior construction of the handling unit 14.

An opening **14*b* is defined in a specified position on an upstream side wall of the handling unit 14 with respect to a direction of transport of a copy sheet. The opening 14*b* is designed to introduce the copy sheet discharged from the image forming unit 2 to the handling unit 14. Downstream of the opening 14*b* are formed a transport path 14*c* along which the discharged copy sheet is transported to the discharge tray 17 and another transport path 14*d* along which it is transported to the sorter 15**.

Right downstream of the transport path **14*d* is arranged the sorter 15, and below the same is arranged the sheet processing device 30**.

In the sorter 15, a pair of cylinders (bin elevating means) 23 for shifting a stack of bin trays 16 upwards and downwards are provided upstanding at opposite sides of the bin trays 16. On the surface of each cylinder 23 is defined a groove 24 in the form of a spiral having a specified pitch. Second pins (bin elevating means) 21 of the bin trays 16 to be described later are engageable with the respective spiral grooves 24. A bottom end of each cylinder 23 is connected to a drive motor (drive means) 230 disposed below the sheet processing device 30 through a drive transmission mechanism including a timing belt 231, bevel gears 232, 233, and timing belt 234. By driving the drive motor 230 in a forward or reverse direction, the torque of the drive motor 230 is transmitted to the cylinders 23 through the timing belt 234, bevel gears 233, 232, and timing belt 231, and thereby the cylinders 23 are rotated in the corresponding direction. During the rotation of the cylinders 23, the second pins 21 slide along the grooves 24, with the result that the bin trays 16 are shifted upwards or downwards according to the pitch of the grooves 24.

The bin trays 16 each have a planar portion 26 for bearing the copy sheets thereon and an L-shaped stopper 25 for preventing falling-off of the copy sheets and aligning rear edges thereof. The stopper 25 is rotatably connected to the planar portion 26 through a connecting portion 27, such that a specified processing such as stapling and punching can be applied to the rear edge portion of the copy sheet set placed on the bin tray 16 as will be described later. The stopper 25 is rotatable between a first position where it is in line with the planar portion 26 and a second position where it is rotated clockwise by a specified amount in the drawing of FIG. 1.

At a leading end of each planar portion 26 is provided a first pin 20 projectingly outwards from each of opposite side ends thereof. Further, at the rear end of each planar portion 26 are provided a second pin 21 and a third pin 22 projectingly outwards from each of opposite side ends thereof, the second and third pins 21, 22 spaced apart by a specified distance along the side of the planar portion 26. The first pins 20 are engaged with unillustrated guide grooves formed on opposite side walls of the sorter 15 and tilted downwards to the right in the drawing of FIG. 1, thereby tilting the bin trays 16 at a specified angle with respect to a vertical direction and assisting sliding of the bin trays 16. Due to the inclination of the bin trays 16, the copy sheets discharged thereto slide down, and rear edges thereof come to contact with a bent portion of the stopper 25 and are thereby aligned.

Figure 7:
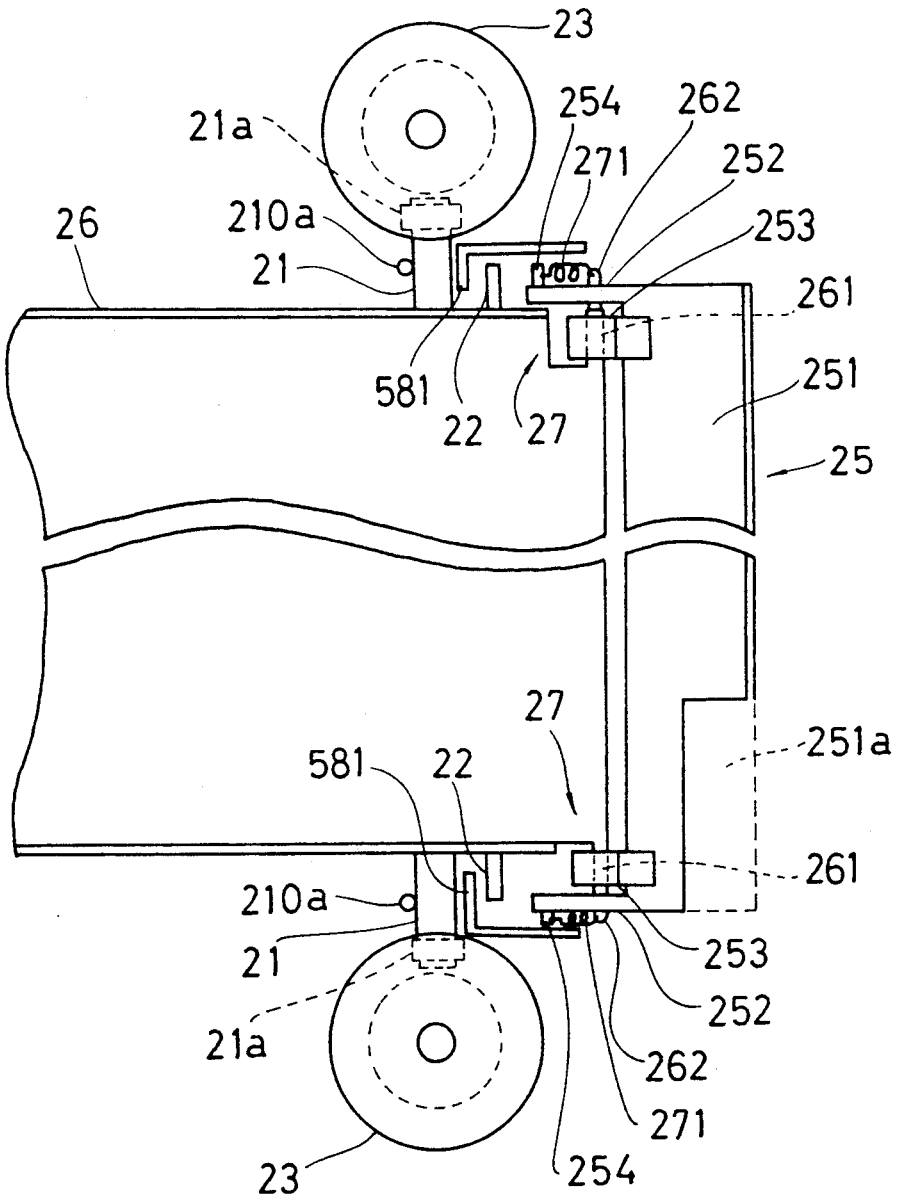
FIG. 7 is a plan view showing a construction of an essential portion of a bin tray employed in the sorting unit.

As shown in FIG. 7, a roller **21*a* is rotatably mounted on each second pin 21 at a leading end thereof, and relatively rolls along the groove 24 according to rotation of the cylinder 23. Preferably, the roller 21***a* may be mounted on the second pin 21 through a bearing. The stack of vertically arranged bin trays 16 are mounted in the sorter 15 by fitting the rollers 21*a* of the second pins 21 to the grooves 24 of the cylinders 23.

The third pins 22 are pushed by restraining portions 581 of brackets (moving means) 58 to be described later, and thereby causing the bin trays 16 to be disengaged from the grooves 24 of the cylinders 23.

As described above, the rollers 21*a* are mounted at the leading ends of the respective second pins 21 so as to reduce the frictional force which will act between the second pins 21 and grooves 24. Accordingly, in the case where the bin trays 16 are shifted upwards or downwards, particularly in the case where the bin trays 16 are shifted upwards or subjected to a large load due to a great number of copy sheets placed thereon, the second pins 21 are permitted to move smoothly relatively along the grooves 24. As a result, the bin trays 16 can be easily shifted upwards and downwards and also the frictional sounds can be reduced.

Figure 2:
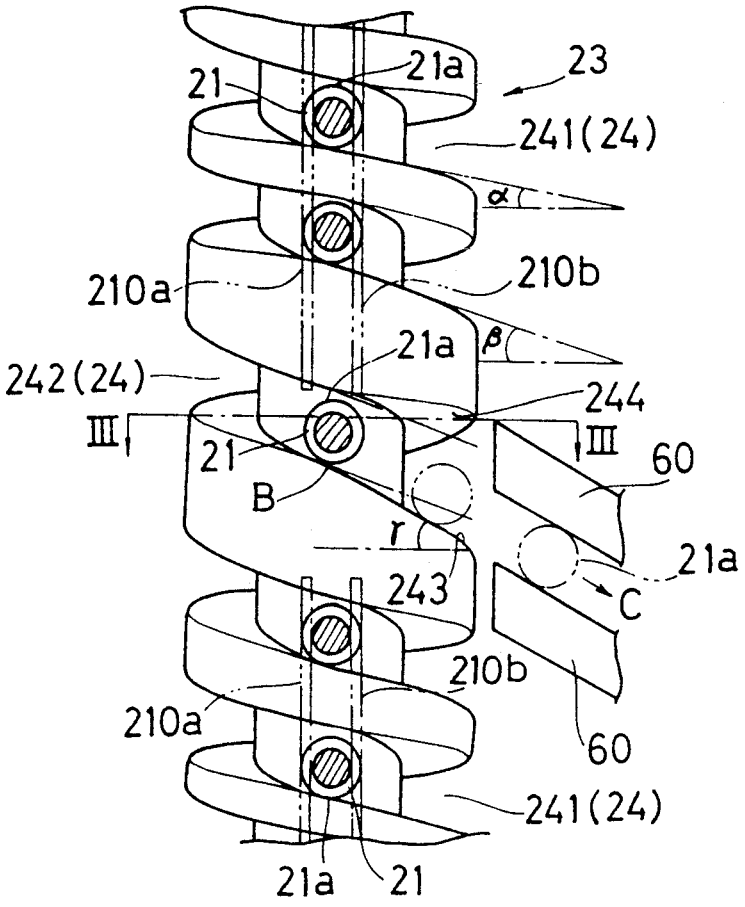
FIG. 2 is a side view showing a portion of a rotatable cylinder provided in the sorting unit.

When a specified sheet processing is to be applied to the copy sheet sets upon completion of a sorting operation, the cylinders 23 are rotated by 360 degrees and stop rotating at a specified stop angular position as will be described later. The stop angular position is an angular position of the cylinders 23 where rotation thereof should be stopped. According to rotation of the cylinders 23, the stack of bin trays 16 are shifted upwards or downwards one stage after another so as to set the bin trays 16 bearing the copy sheet set to be processed in a specified position. In this state, an opening defined between two adjacent guide rails 60 is in line with the grooves 24 of the cylinders 23 as shown in FIG. 2. Accordingly, the second pins 21 (rollers 21*a*) are disengaged from the grooves 24, and slide along an inclination formed by the guide rails 60 toward the sheet processing device 30 (to a retracted position). The second pins 21 smoothly move along the guide rails 60 through the rollers 21*a*. Provision of the rollers 21*a* may not be necessary provided that the second pins 21 are formed of material having low friction resistance.

Referring back to FIG. 1, a detector including a pulse plate 235 and a rotation sensor 236 is disposed in specified positions at a bottom end portion of one of the cylinders 23. The pulse plate 235 is concentrically mounted on the cylinder 23 and has a plurality of tiny slits 235*a* defined therein at specified pitches in a circumferential direction thereof. The rotation sensor 236 is fixed to a main body of the sorter 15, and includes a light emitter and a photodetector. The light emitter and the photodetector of the sensor 236 are arranged so as to oppose to each other with the pulse plate 235 held therebetween. When the cylinder 23 is rotated by driving the drive motor 230, the pulse plate 235 is rotated together with the cylinder 23. As the pulse plate 235 is rotated, the slits 235*a* defined therein pass between the stationary light emitter and photodetector, and thereby the photodetector is turned on and off to generate pulse signals. As a result, the pulse signals corresponding to a rotating amount of the pulse plate 235, i.e. cylinder 23, are input from the rotation sensor 236 to a control unit 162 to be described later.

Figure 4A:
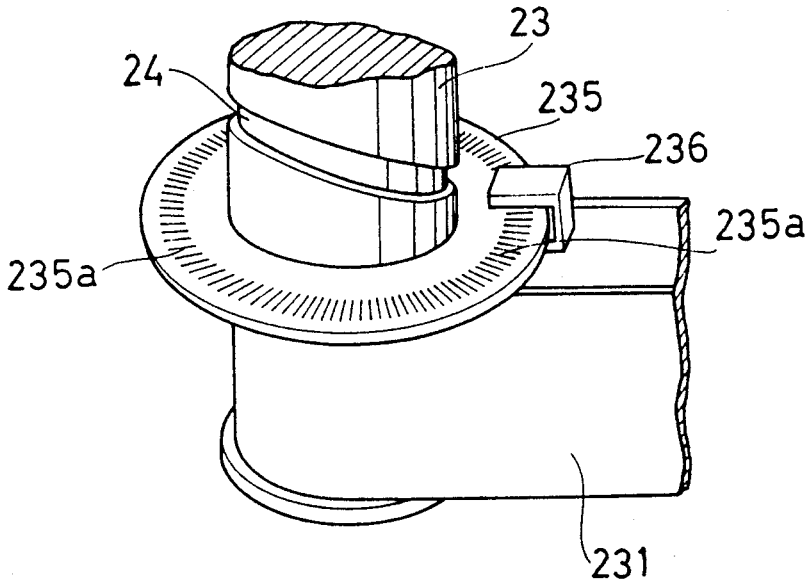
FIG. 4A is a perspective view showing positional relationship between a sensor for detecting a rotating amount of the cylinder and a pulse plate.
Figure 4B:
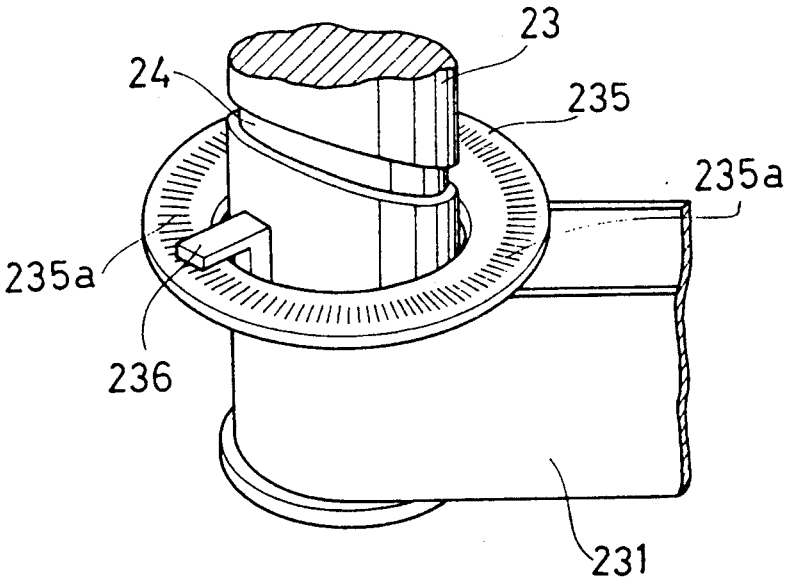
FIG. 4B is a perspective view showing positional relationship between another rotation sensor and the pulse plate.

The pulse plate 235 and rotation sensor 236 may be arranged as shown in FIG. 4B. Specifically, the sensor 236 is fixed to the cylinder 23 and the pulse plate 235 configured in the form of a doughnut concentric with the cylinder 23 is fixed to the sorter main body. The light emitter and photodetector of the sensor 236 move above and below the slits 235*a*, so that the sensor 236 outputs pulse signals corresponding to the rotating amount of the cylinder 23.

Figure 5:
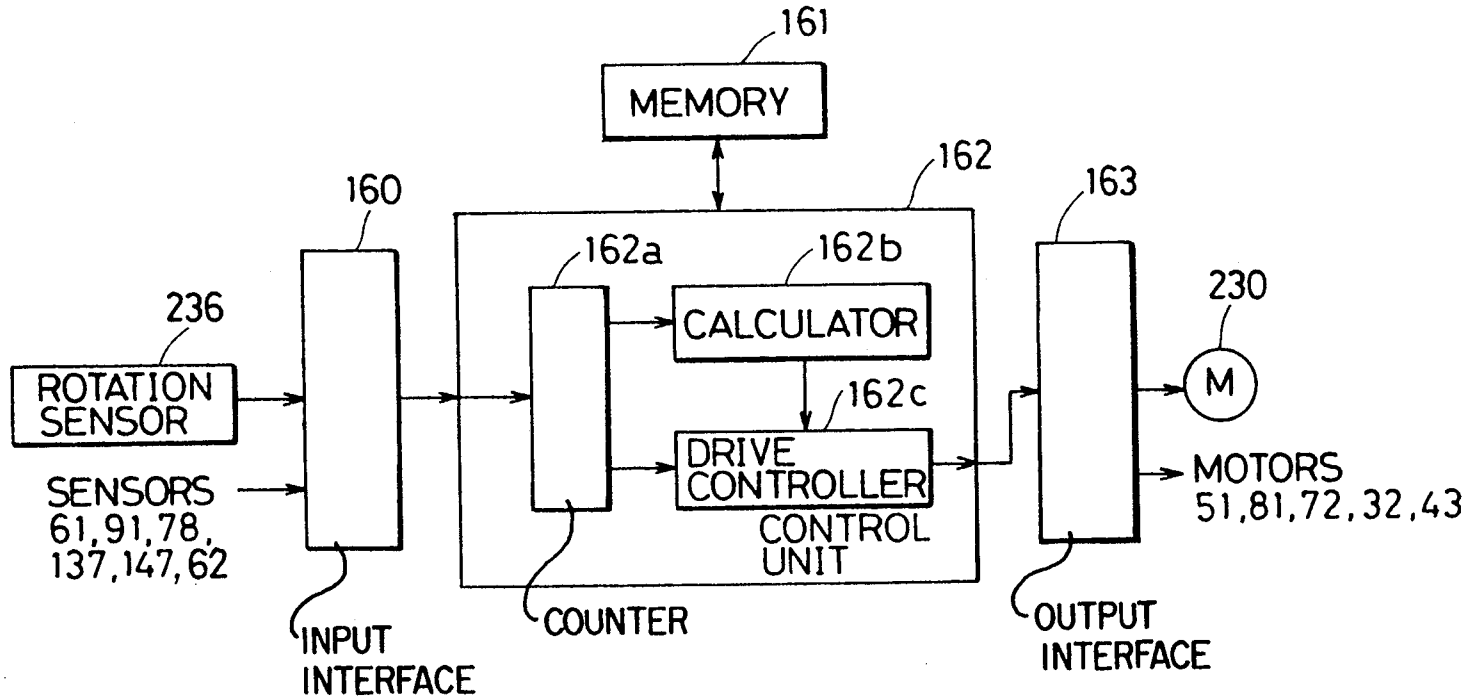
FIG. 5 is a block diagram showing a control system for controlling operations of the sorting unit.

A control system for controlling the driving of the drive motor 230 or the like will be described with reference to FIG. 5.

This control system consists essentially of an input interface 160, memory 161, controller 162, and output interface 163. The memory 161 includes a read only memory (ROM) and a random access memory (RAM), and stores various pulse numbers, a control program, etc. The stored pulse numbers include a specified pulse number and a reference pulse number. The specified pulse number is the number of pulses input to the control unit 162 until the control unit 162 sends a drive stop signal to the drive motor 230 following start of high speed rotation of the cylinders 23 so as to apply the sheet processing to the copy sheet set. On the other hand, the reference pulse number is the number of pulses input to the control unit 162 until rotation of the cylinders 23 come to a complete stop immediately after the drive stop signal is output to the drive motor 230. The memory 161 also stores several types of standard processing positions where punching and stapling are applied to the copy sheet set, such as punching positions corresponding to the A-4 or B-5 sized copy sheets, and sequences of processing according to processing modes selectable through the use of the selection key panel 13.

The control unit 162 includes a counter 162*a*, calculator 162*b* and drive controller 162*c*. The control unit 162 receives the pulse signals from the rotation sensor 236 through the input interface 160, and sends a drive control signal through the output interface 163 to the drive motor 230 in accordance with the received pulse signals. Further, the control unit 162 control the driving of motors 51, 81, 72, 32, and 43 in accordance with sensor signals from sensors 61, 62, 91, 78, 137, and 147.

The counter 162*a* counts the pulse signals from the rotation sensor 236 and outputs a count value as a rotating amount of the cylinders 23 to the calculator 162*b* and drive controller 162*c*. The calculator 162*b* calculates a remainder of the number of pulse signals counted until rotation of the cylinders 23 is stopped immediately after the drive stop signal is sent to the drive motor 230 minus the reference pulse number stored in the memory 161, and outputs the calculation result to the drive controller 162*c*.

When the count number from the counter 162*a* reaches the specified count number stored in the memory 161 after rotation of the cylinders 23 is started to apply the sheet processing to the copy sheet sets placed on the bin trays 16, the drive controller 162*c* sends the drive stop signal to the drive motor 230 so as to stop the driving thereof. Further, the drive controller 162*c* causes the motor 230 to rotate in the forward or reverse direction, for example, at low speed so as to rotate the cylinders 23 by an amount corresponding to the remainder calculated by the calculator 162*b* (corrective rotation of the cylinders 23). As a result, the rotation of the cylinders 23 can be stopped at the stop angular position.

If the specified pulse number is set at a pulse number substantially corresponding to one turn of the cylinders 23, an amount of the corrective rotation can be reduced. Even after the drive stop signal is sent to the drive motor 230, the cylinders 23 rotate a certain amount due to the inertial force of the motor 230 and cylinders 23. Accordingly, it is desirable for the drive controller 162*c* to send the drive stop signal to the motor 230 before the cylinders 23 reach the stop angular position. In addition, it is advantageous to set the specified pulse number smaller than the pulse number corresponding to one turn of the cylinders 23.

An exemplary control operation for the drive motor 230 will be described next with reference to a flow chart shown in FIG. 6. In this flow chart, it is assumed that the motor 230 is driven in the forward direction at high speed so as to shift the bin tray stack upwards to set one bin tray 16 in the specified position.

Upon start of the driving of the motor 230 in the forward direction, the counter 162*a* starts counting the pulse signals from the rotation sensor 236 in Step S41. In Step S42, it is discriminated whether the count value of the counter 162*a* has reached the specified pulse number. The motor 230 is kept driven until the count value reaches the specified pulse number (NO in Step S42).

Upon the count value reaching the specified pulse number (YES in Step S42), the drive stop signal is sent to the motor 230 so as to stop the driving thereof, and the counter 162*a* is reset and started in Step S43.

In Step S45, it is discriminated whether a specified period has elapsed following the output of the drive stop signal. The specified period is measured by a timer provided in the control unit 162, and is slightly longer than a period required for the cylinders 23 to stop rotating following the output of the drive stop signal. This routine stays in Step S45 while counting the pulse signals until lapse of the specified period (NO in Step S45).

Upon lapse of the specified period (YES in Step S45), a remainder X is calculated by subtracting the reference pulse number K0 from a count value K in Step S46.

$$X=K-K0$$

The count value K is the number of pulse signals counted during the specified period.

Subsequently, it is discriminated whether the remainder X is positive, negative, or zero in Step S47. If $X>0$, it means that the cylinders have been rotated beyond the stop angular position. Accordingly, the motor 230 is driven in the reverse direction, for example, at low speed by an amount corresponding to the remainder X so as to return an angular position of the cylinders to the specified stop angular position in Step S48.

On the other hand, if $X<0$, it means that the cylinders 23 have not been rotated enough to reach the stop angular position. Accordingly, the motor 230 is driven in the forward direction, for example, at low speed by an amount corresponding the remainder X so as to rotate the cylinders 23 up to the stop angular position in Step S49.

If $X=0$, it means that rotation of the cylinders 23 has been stopped at the stop angular position thereof. Accordingly, the motor 230 is not driven.

Figure 6:
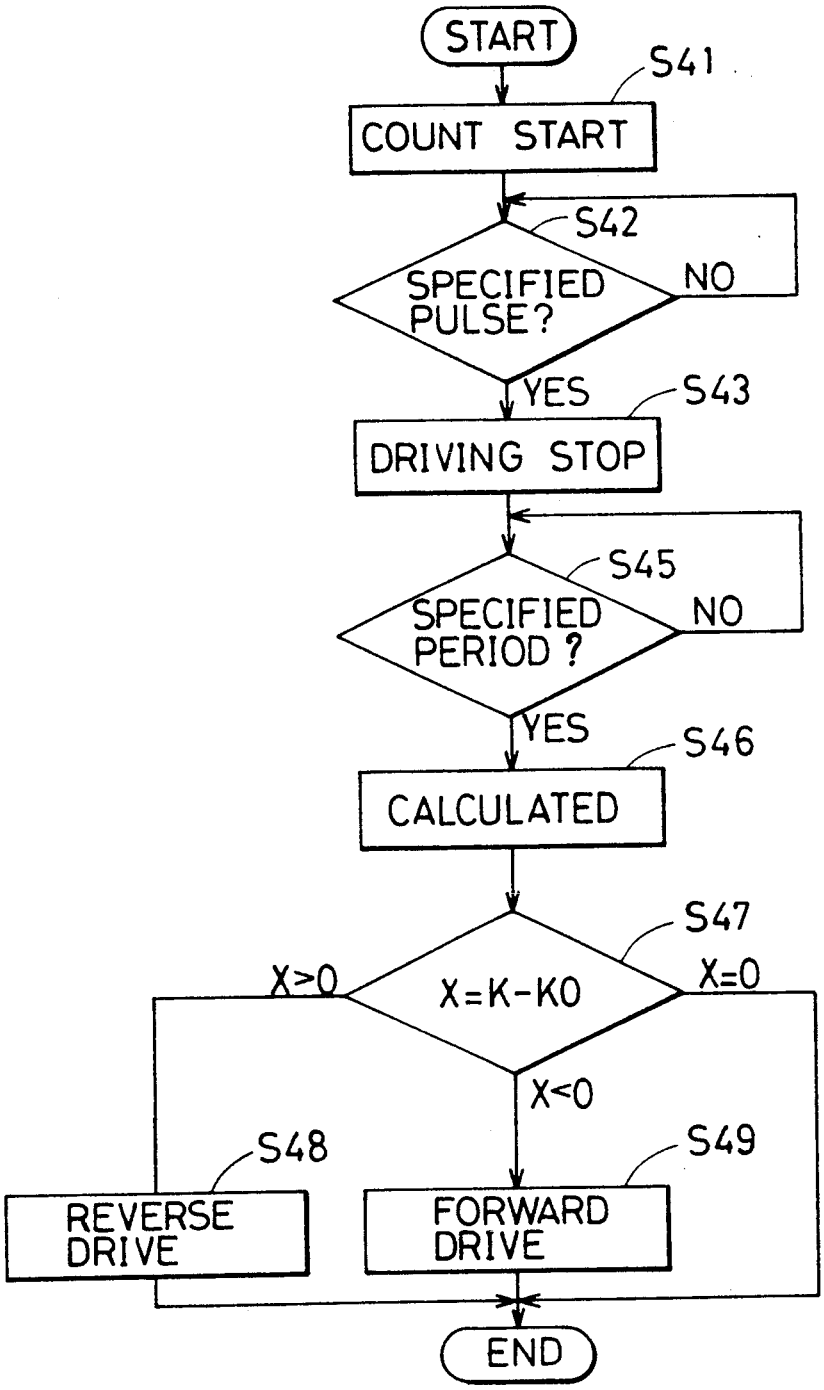
FIG. 6 is a flow chart showing operations of the control system.

In the case where the bin tray stack is shifted downwards, the control operation for the motor 230 is basically similar to the one shown in the flow chart of FIG. 6 except: the motor 230 is driven in the reverse direction in Step S41; is driven in the forward direction in Step S47; and is driven in the reverse direction in Step S49.

Further, in the flow chart of FIG. 6, it is determined that rotation of the cylinders 23 has been stopped upon lapse of the specified period in Step S45. However, such determination may be made upon detecting that no more pulse signal is sent from the rotation sensor 236.

As described above, the rotating amount of the cylinders 23 is detected by the detector including the pulse plate 235 and rotation sensor 236 provided at one of the cylinders 23 so as to time the output of the drive stop signal to the motor 230 and also to discriminate a deviation from the stop angular position. Accordingly, the construction for controlling the driving of the motor 230 can be simplified. Further, since the detector is provided at the cylinder 23, rotation of the cylinders 23 can be reliably stopped at the stop angular position without being subjected to the influence of the backlash of the timing belt 231, 234 and bevel gears 232, 233, compared with a case where the detector is provided at the motor 230.

Figure 8:
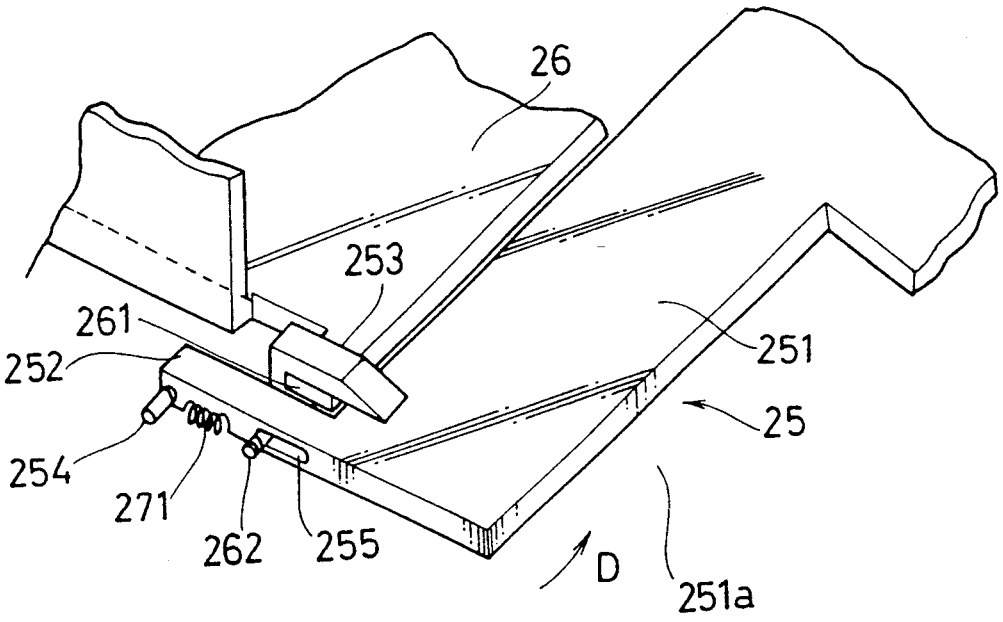
FIG. 8 is a perspective view showing a construction of an essential portion of a connecting portion of the bin tray.

Next, the connecting portion 27 of the bin tray 16 will be described with reference to FIGS. 7 and 8. FIG. 7 is a plan view showing an essential construction of the connecting portion 27; and FIG. 8 is a perspective view enlargedly showing an essential portion of the connecting portion 27.

The planar portion 26 of the bin tray 16 is formed with an engaging member 261 at each of opposite rear side portions thereof. At a leading end of each member 261 is provided a fourth pin 262 projecting outwards.

On the other hand, a flat portion 251 of the stopper 25 is formed with a projection 252 projecting along the side thereof at each of opposite leading side portions thereof. In a specified position inward of each projection 252 is provided an engaging claw 253 projecting in parallel with the projection 252. The claw 253 is engageable with the corresponding engaging member 261 of the planar portion 26. A leading ends of each claw 253 is bent downwards, forming a bent portion. The bent portion the comes to contact with a leading face of the member 261, and thereby the member 261 and claw 253 are engaged with each other. Further, a fifth pin 254 is provided projectingly outwards at an outer side face of a leading end of each projection 252. An oblong hole 255 long in the lengthwise direction of the bin tray 16 is defined at a base end of each projection 252, the hole 255 extending in the widthwise direction of the bin tray 16. As will be seen from FIGS. 7 and 8, a notch 251*a* is defined at one corner portion of the rear end portion of the stopper 25 for the reason to be described later.

The stopper 25 is connected to the rear end of the planar portion 26 by fitting the fourth pins 262 into the holes 255 and engaging the claws 253 with the members 261. Further, a spring 271 is provided between the fourth pin 262 and fifth pin 254. The spring 271 biases in such a manner that the stopper 25 is spaced away from the planar portion 26 to maintain engagement of the stopper 25 and planar portion 26.

The stopper 25 is biased by an unillustrated biasing device including a helical spring in such a direction as to rotate counterclockwise about the fourth pins 262, i.e. in an arrow direction D in FIG. 8. With this arrangement, even if the engagement of the claws 253 and members 261 is released, the stopper 25 is not to rotate clockwise due the weight thereof and therefore the rear end of the bin tray 16 is not to be opened up.

Accordingly, the stopper 25 is rotatable to the second position about the fourth pins 262 after releasing engagement of the claws 253 and members 262 by moving the stopper 25 toward the planar portion 26 by a specified distance.

With the above construction, when the bin tray 16 is in a normal sorting position, the stopper 25 is in line with the planar portion 26, i.e. in the first position, and the claws 253 are engaged with the members 261. Accordingly, there will be no such likelihood that the stopper 25 is rotated to the second position due to the weight of a multitude of copy sheets to open up the rear end of the bin tray 16. The copy sheets will not inadvertently fall off the bin tray 16.

Further, in the case where a set of copy sheets is manually placed on the bin tray 16 to apply the sheet processing thereto, the stopper 25 will not inadvertently be rotated to misalign edges of the copy sheets. Moreover, even in the case where the operator accidentally inserts his hand between two adjacent bin trays 16 from the leading ends thereof, placing undesirable force on the bin trays 16, the stoppers 25 are locked in the first position. Accordingly, the copy sheets placed on the bin trays 16 can be kept edge-aligned.

In the foregoing embodiment, the engaging claws 253 and engaging members 261 function as a locking mechanism for lockingly connecting the stopper 25 with the planar portion 26. However, in accordance with the invention, the locking mechanism is not limited to the above.

For instance, a locking mechanism may be as follows. An engaging member is provided in a specified position at a lower face of each projection 252, the engaging member projecting inwards from the projection 252. A notch is defined in a specified position at each of opposite sides of the planar portion 26. The stopper 25 is lockingly connected with the planar portion 26 by engaging the engaging member with a lower surface of the planar portion 26. On the other hand, the stopper 25 can be released from the locked state by moving the stopper 25 in the lengthwise direction of the bin tray 16 relative to the planar portion 26 so as to move the engaging members to the notches.

Further, in the foregoing embodiment, when the stopper 25 is moved away from the planar portion 26, the engaging claws 253 are engaged with the engaging members 261, and thereby the stopper 25 is locked in the first position. When the bin tray 16 is moved toward the sheet processor 28 to carry out the sheet processing to the copy sheet set, the stopper 25 is relatively moved toward the planar portion 26 according to movement of the bin tray 16, thereby enabling the stopper 25 to be released from the locked state thereof. However, the locking mechanism may be constructed such that the stopper 25 is lockingly connected with the planar portion 26 when moved toward the planar portion 26.

Moreover, it may be appropriate that the locked state of the stopper 25 be released to rotate the stopper 25 to the second position to open up the rear end of the bin tray 16 after the bin tray 16 is moved to the retracted position.

Next, there will be described a detailed construction of the cylinders 23 with reference to FIG. 2.

The groove 24 is defined on the cylinder 23, forming upper and lower guide faces. The groove 24 consists essentially of a region 241 and another region 242. The groove 24 extends at an inclination $\alpha$ with respect to the horizontal direction in the region 241 while extending at an inclination $\beta$ (>) with respect thereto in the region 242. While the second pins 21 of the bin trays 16 are in the region 241, the bin trays 16 are shifted upwards or downwards by the aforementioned specified distance to a next stage. Further, the region 242 is substantially on a level with a discharge outlet of the transport path 14*d* where the copy sheet is discharged. The region 241 is formed such that the bin tray 16 located in the region 241 is more spaced away from the adjacent one(s) than the other bin trays 16 in the region 241 so as to facilitate discharge of the copy sheet thereto.

Figure 3:
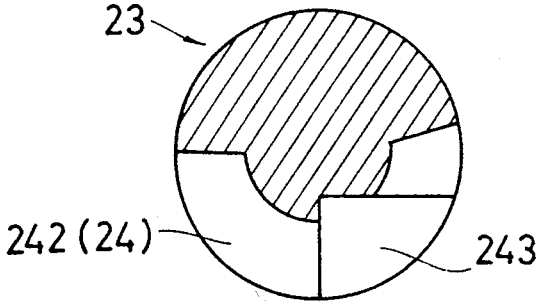
FIG. 3 is a sectional view taken along the line III—III in FIG. 2.

In a position on the lower guide face serving as a retraction start position (original position) B of the second pin 21 is formed a flank 243 (see FIG. 3) inclined at the same angle $\gamma$ as the bin tray 16 with respect to the horizontal direction and extending in a retracting direction, i.e. an arrow direction D in FIG. 2. Upper and lower guide rails 60 defines a guide path so as to guide the second pin 21 to the retracted position. Slide faces of the guide rails 60 are inclined at the same angle $\gamma$ as the bin tray 16, so that the flank 243 is in line with the slide face of the lower guide rail 60. When the sheet processing is applied to a copy sheet set, the second pin 21 (roller 21*a* in the case where the roller 21*a* is mounted on the second pin 21) moves from the retraction start position B to the guide rails 60 along the flank 230, and further moves to the retracted position along the guide path. With the flank 230 having the same inclination $\gamma$ as the guide rails 60, the second pin 21 is allowed to retract from the position B in a direction parallel to the inclination $\gamma$ and therefore to move smoothly from the groove 24 to the guide path.

At a portion of the upper guide face opposing the flank 243 is formed a flank 244, thereby widening the groove 24 at a position facing the guide rails 60, i.e. guide path. This enables the second pin 21 to move smoothly from the guide path to the groove 24 without striking against an upper edge of the groove 24 even if the groove 24 is slightly located at an upper level than the guide path, when the second pin 21 is returned to the position B from the retracted position.

Further, upstanding rails 210*a*, 210*b* are arranged beside the cylinder 23 so as to hold the second pins 21 therebetween. The rails 210*a*, 210*b* function to prevent the pins 21 from getting off the groove 24 while the cylinder 23 is rotated. These rails are partially disconnected near the position B, thereby forming upper rail portions and lower rail portions. The restraining portion 581 of the bracket 58 to be described later is fittable in space between the upper and lower rail portions of the rail 210*b* located closer to the guide rails 60. A construction of the restraining portion 581 will be described later. Hereinabove, description is directed to only one cylinder 23 and its relating elements. However, it will be appreciated that the other cylinder and its relating elements have the same construction and function as the above.

With the above construction, the cylinders 23 are rotated one turn by means of the motor 230 in synchronism with a discharging timing of the copy sheet, and thereby the bin tray stack is shifted upwards or downwards by the pitch of the grooves 24 one stage after another. In this way, the copy sheets are sorted. When the specified sheet processing is applied to the respective copy sheet sets upon completion of the sorting operation, the bin tray 16 bearing the copy sheet set to be processed is shift upwards or downwards to the retraction start position B, and move by a specified distance to the retracted position along inclination of the flanks 243 and guide rails 60. Since the bin tray 16 moves in this manner, the distance the sheet processor 28 is moved toward the bin tray 16 can be reduced and a construction of a mount table 44 to be described later can be simplified.

Referring back to FIG. 1, the sheet processing device 30 is provided with the sheet processor 28 for applying a specified processing to a sorted set of copy sheets placed on the bin tray 16, and a support 29 on which the sheet processor 28 is mounted. The support 29 is mounted on a base reciprocally movable in the widthwise direction of the bin tray 16 (i.e. a vertical direction to the drawing of FIG. 1). The support 29 includes the mount table 44 reciprocally movable in a tilting direction of the bin tray 16. The sheet processor 28 is detachably mountable on the mount table 44. By combining movement of the support in the widthwise direction of the bin tray 16 with movement of the mount table 44 in the tilting direction thereof, the sheet processor 28 is allowed to apply the specified processing to a rear edge portion of the copy sheet set in a desired position.

A holder 86 is adapted for pressingly holding the edge-aligned copy sheet set against the planar portion 26 to prevent the copy sheets from falling off the bin tray 16 when the stopper 25 is rotated to the second position.

Detailed constructions and operations of the sheet processing device 30 and holder 86 will be described later.

Figure 10:
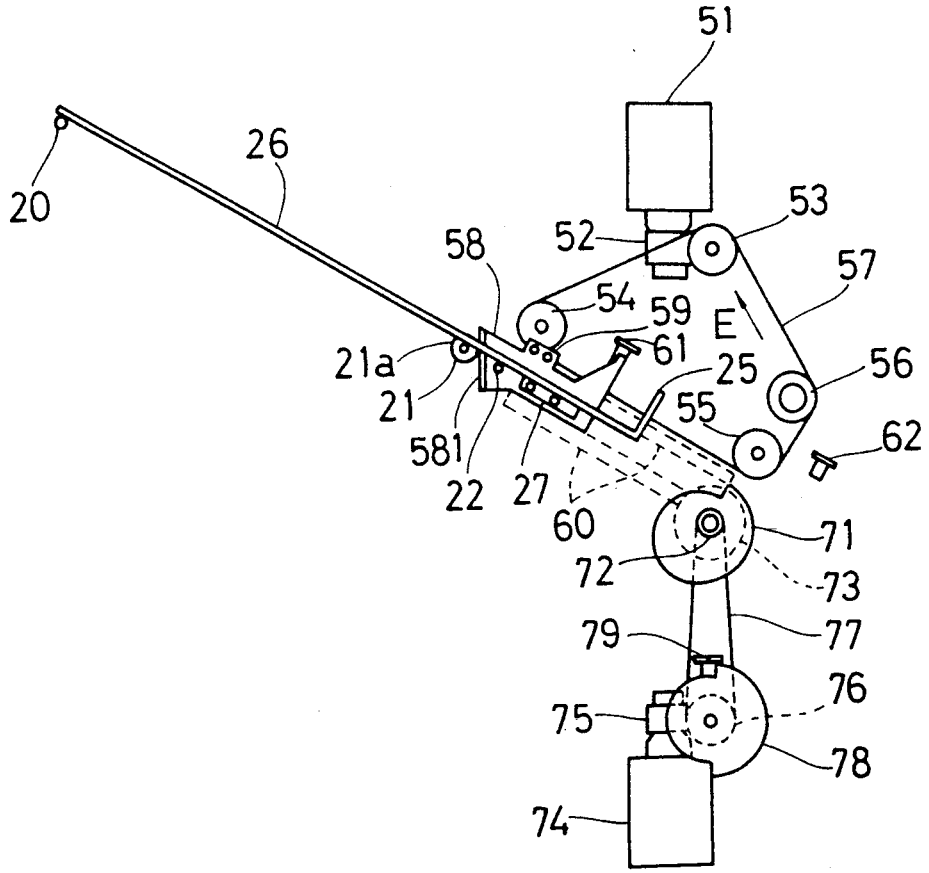
FIG. 10 is a diagram showing a bin moving mechanism.

FIG. 10 is a diagram showing a bin moving mechanism for moving the bin tray 16 from the retraction start position B to the retracted position, and vice versa.

In this figure, indicated at 51 is a motor for moving the bin tray 16 along the retracting direction, and at 52 a gear for transmitting the torque of the motor 51 to a sprocket 53. A chain 57 is wound on the sprockets 53, 54, 55, and 56, and accordingly the torque of the motor 51 are transmitted from the sprockets 53 to the other sprockets 54, 55, and 56 through the chain 57. The sprockets 53, 54, 55, and 56 and the chain 57 constitute a drive transmission mechanism for transmitting the torque of the motor 51. The drive transmission mechanism is provided at each of opposite sides of the bin tray 16. The motor 51 is coupled with one of the drive transmission mechanisms. The driving force of the motor 51 is transmitted to the other drive transmission mechanism through a connecting shaft connecting the sprockets 53 disposed at the opposite sides.

Figure 9:
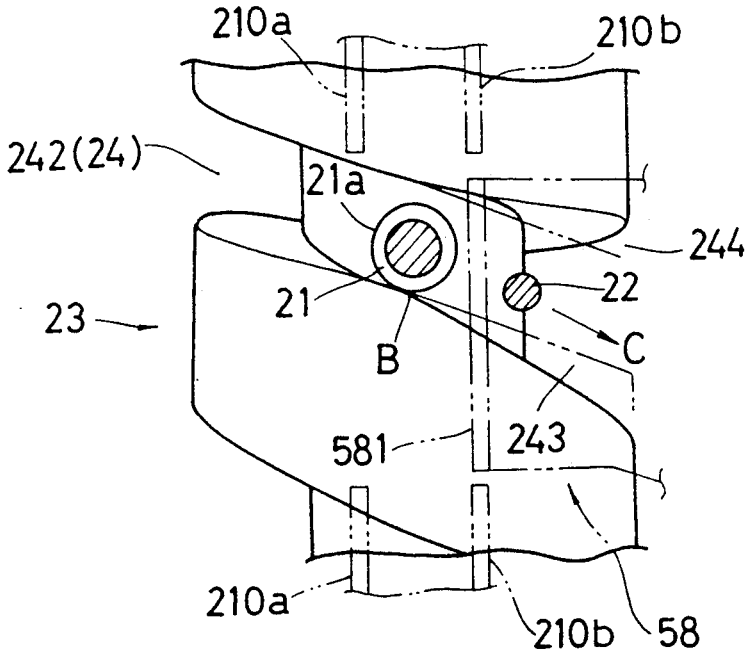
FIG. 9 is a side view showing a construction of an essential portion of the cylinder.

The bracket 58 is connected to each chain 57 through a connecting portion 59. A leading end of the bracket 58 is bent toward the bin tray 16, thereby forming the restraining portion 581. When the bin tray 16 is in the retraction start position B, the restraining portions 581 are held between the second and third pins 21, 22 so as to restrain the second pins 21 from getting off the grooves 24 (see FIG. 9).

In the case where the sheet processing is applied to the copy sheet set, the brackets 58 push the third pins 22 to move the bin tray 16 to the retracted position while pushing the second pins 21 to return the bin tray 16 to the retraction start position B.

A first sensor 61 and a second sensor 62, both including a photointerrupter or the like, detect the presence or absence of the bracket 58.

An eccentric cam 71 has a contact portion 71*a* formed in a specified position on its outer circumference. The cam 71 causes the engaging claw 253 of the stopper 25 to be disengaged from the engaging member 261 of the planar portion 26, and also causes the stopper 25 to rotated clockwise to the second position so as to open up the rear end of the bin tray 16.

A stay 73 is rotatably mounted on a rotatable shaft 72 of the eccentric cam 71, and is in contact with the lower surface of the bin tray 16 when the bin tray 16 is in the retracted position, supporting the bin tray 16 from below. With the stay 73, there can be prevented warping of the bin tray 16 at the time when the copy sheet set placed thereon is pressed thereagainst by the holder 86. In this respect, the stay 73 assists the holding of the copy sheet set by means of the holder 86.

A motor 74 drivingly rotates the eccentric cam 71. A gear 75, sprocket 76, and chain 77 are arranged so as to transmit the torque of the motor 74 to the rotatable shaft 72 of the cam 71. A pulse plate 78 rotates together with the sprocket 76. A third sensor 79, including a photointerrupter or the like, detects a rotating amount of the sprocket 76 through the pulse plate 78. Based on an output of the sensor 79, the rotating amount of the stopper 25 is regulated. The cam 71, sprocket 76, and chain 77 constitute a drive transmission mechanism for transmitting the torque of the motor 74. The drive transmission mechanism is provided at each of opposite sides of the bin tray 16. The motor 74 is coupled with one of the drive transmission mechanisms. The driving force of the motor 74 is transmitted to the other drive transmission mechanism through a connecting shaft connecting the sprockets 76 disposed at the opposite sides.

With the above construction, in the case where the specified sheet processing is applied with the use of the sheet processor 28, the motor 51 is driven in the forward direction to rotate the sprockets 53 through the gear 52. Thereby, the chains 57 wound on the sprockets 53, 54, 55, and 56 moves in an arrow direction E in FIG. 10. According to movement of the chains 57, the brackets 58 connected thereto through the connecting portions 59 starts retracting along the guide rails 60.

Figure 11:
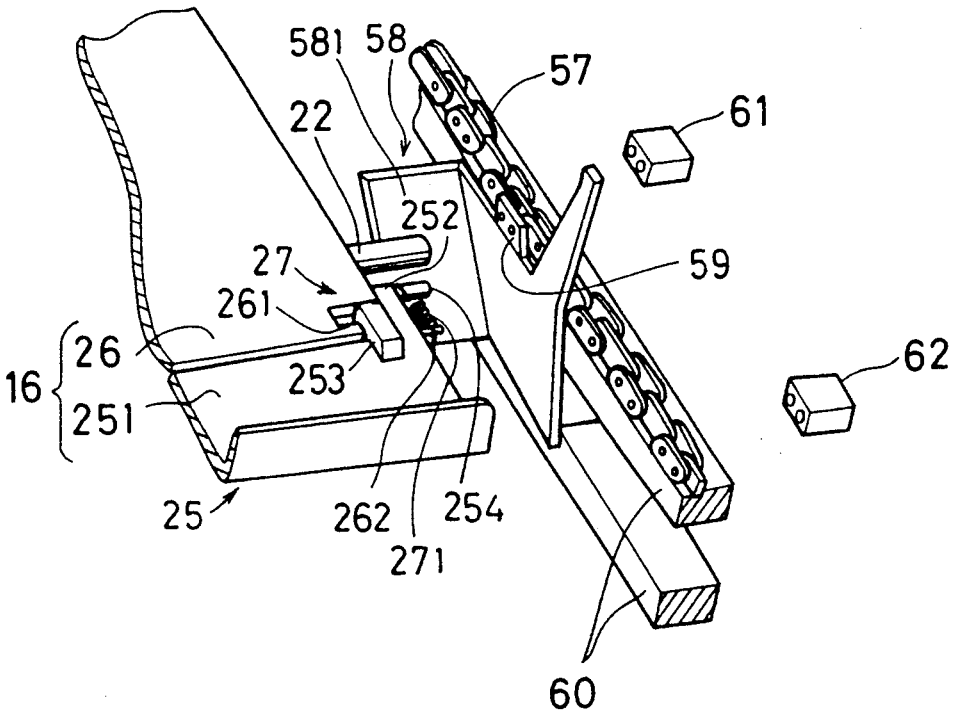
FIG. 11 is a perspective view showing an essential portion of the bin moving mechanism.

At this time, the restraining portions 581 of the brackets 58 push the third pins 22 of the bin tray 16, thereby disengaging the second pins 21 from the grooves 24 of the cylinder 23. After disengaged from the cylinder 23, the bin tray 16 moves along the guide rails 60 according to movement of the brackets 58 as shown in FIG. 11.

Figure 12:
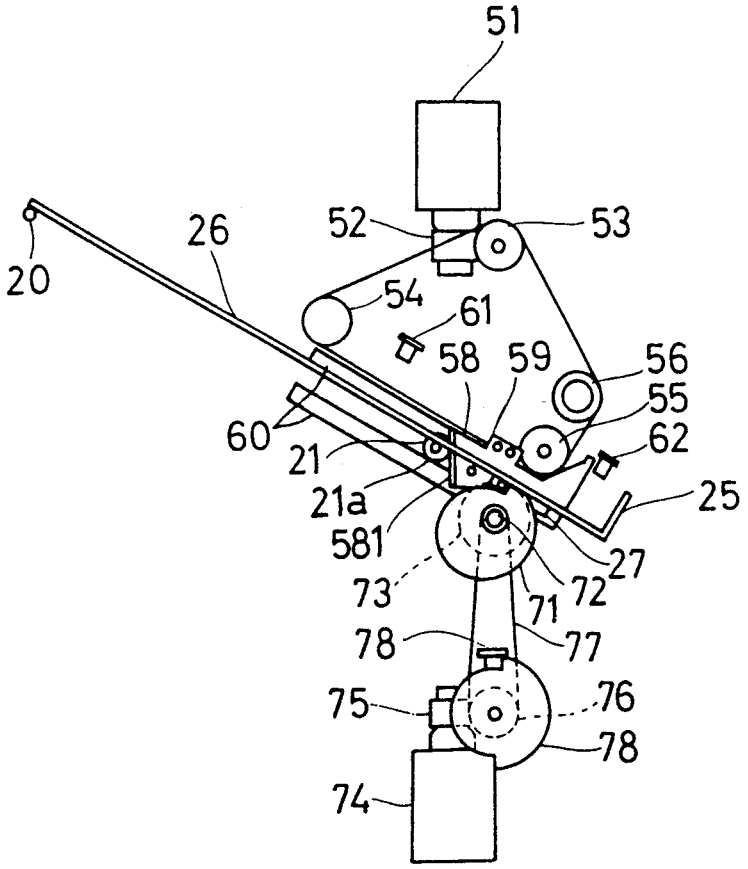
FIG. 12 is a diagram showing a state where the bin tray is in a retracted position thereof.

Retracting by the specified distance, the presence of the bracket 58 is detected be the second sensor 62, and the driving of the motor 51 is stopped based on the detection result of the sensor 62. Accordingly, the bin tray 16 retracts by the specified distance, and stops in the retracted position (a state shown in FIG. 12).

On the other hand, in the case where the bin tray 16 is returned to the original position upon completion of the specified sheet processing, the motor 51 is driven in the reverse direction to rotate the chains 57 in a direction reverse from the direction E. According to reverse movement of the chains 57, the brackets 58 start moving forwards along the guide rails 60.

As the brackets 58 move forwards, the second pins 21 of the bin tray 16 are pushed by the restraining portions 581, and thereby the bin tray 16 moves forwards. When the brackets 58 move forwards by the specified distances, the presence of the bracket 58 is detected by the first sensor 61, and the driving of the motor 51 is stopped based on the detection result of the sensor 61. Accordingly, the bin tray 16 moves forwards by the specified distance, and stopped at the retraction start position (a state shown in FIG. 10).

Figure 13:
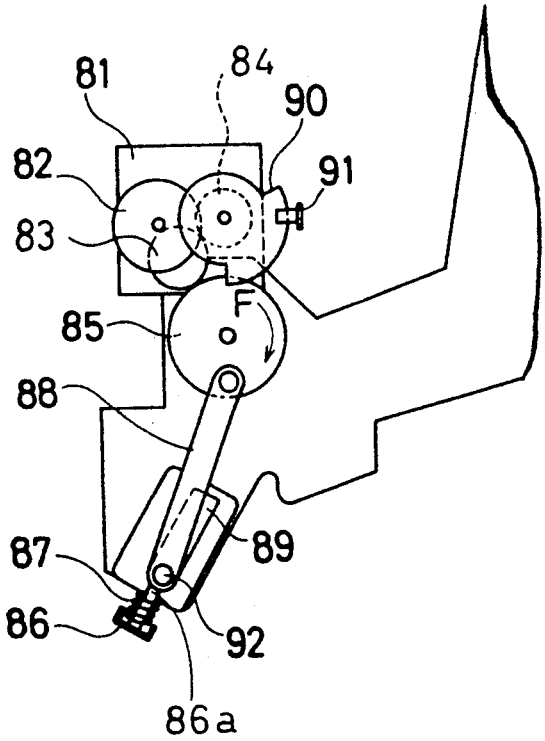
FIG. 13 is a diagram showing a sheet holding mechanism.

FIG. 13 is a diagram showing an exemplary construction of a sheet holding mechanism.

In this figure, indicated at 81 is a motor for driving the sheet holding mechanism. The torque of the motor 81 is transmitted to gears 84, 85 through gears 82, 83. The holder 86 is adapted for pressingly holding the copy sheet set against the planar portion 26 of the bin tray 16. A linkage rod 88 connects the gear 85 with the holder support member 86*a*. An upper end of the linkage rod 88 is rotatably mounted to a side surface of the gear 85 at an eccentric position displaced from a center thereof. A guide rail 89 is provided to guide movement of a connecting pin 92 of the linkage rod 88 and holder support member 86*a*. A spring 87 is mounted on the support member 86*a*, and applies a desirable pressing force to the copy sheet set according to a number of the copy sheets.

A drive transmission mechanism including the gear 85, linkage rod 88, holder support member 86*a*, and guide rail 89 is provided at each of the opposite sides of the bin tray 16. The motor 81 is coupled to one of the drive transmission mechanism. The driving force of the motor 81 is transmitted to the other drive transmission mechanism through a connecting shaft connecting the opposite gears 85.

A pulse plate 90 rotates together with the gear 84. A fourth sensor 91, including a photointerrupter or the like, detects a rotating amount of the gear 84 using the pulse plate 90.

With the sheet holding mechanism thus constructed, when the motor 81 is rotated in a specified direction, the gear 85*s* rotate clockwise (in an arrow direction F in FIG. 13) through the gears 82, 83, and 84. Thereby, the holder 86 coupled to the linkage rods 88 moves downwards along the guide rails 89. On the other hand, the pulse plate 90 rotates together with the gear 84. When the pulse plate 90 rotates by a specified amount, it is detected by the fourth sensor 91. The driving of the motor 81 is stopped based on the detection result of the sensor 91. As a result, the holder 86 is moved downwards by a specified distance.

When moved downwards, the holder 86 comes to contact with an uppermost sheet of the copy sheet set. In this way, downward movement of the holder 86 is restricted by the presence of the copy sheet set. On the other hand, biased downwards by the springs 87, the holder 86 pressingly holds the copy sheet against the planar portion 26.

When the motor 81 is further driven in the specified direction, the holder 86 coupled to the linkage rod 88 moves upwards along the guide rails 89, thereby the sheet holding is released. When the gears 85 rotates just one turn, rotational positions thereof are detected by the pulse plate 90 and fourth sensor 91. The driving of the motor 81 is stopped based on this detection result. [7/6]

There will be next described a releasing operation for the stopper 25 so as to conduct a specified sheet processing to the pressingly held copy sheet set with reference to FIG. 14.

Figure 14A:
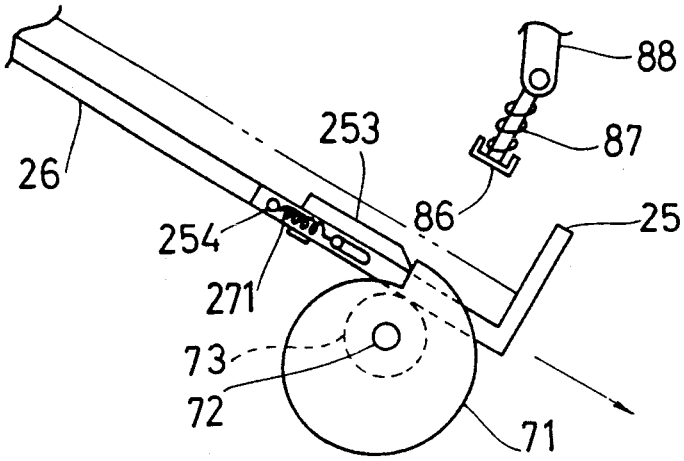
FIGS. 14A, 14B, and 14C are diagrams showing a stopper releasing operation respectively.
Figure 14B:
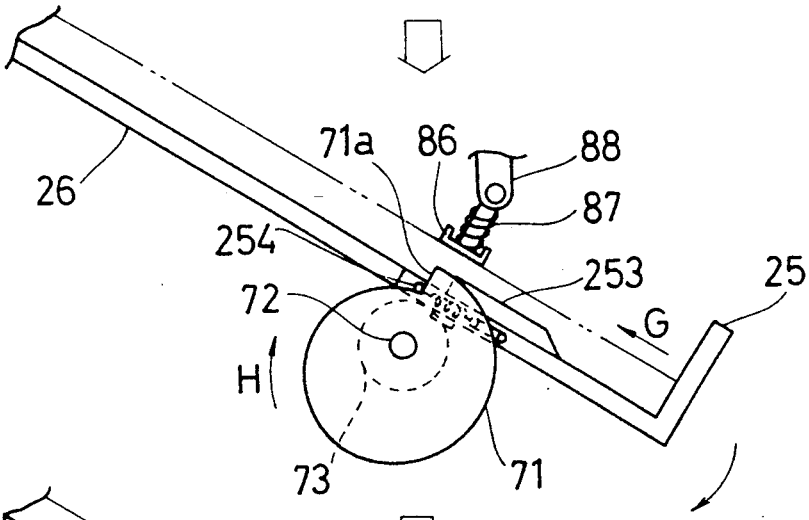
Figure 14C:
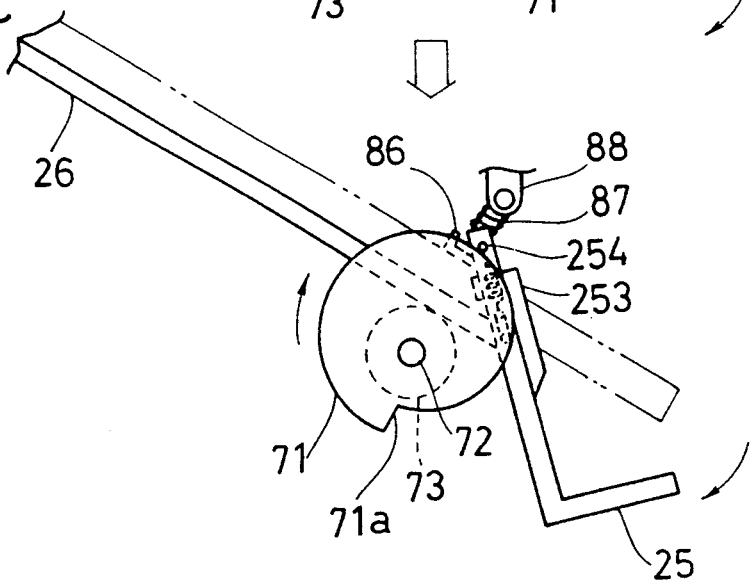

FIG. 14A is a diagram showing a state of the bin tray 16 while moving to the retracted position; FIG. 14B is a diagram showing a state thereof where the bin tray 16 is in the retracted position; and FIG. 14C is a diagram showing a state of the bin tray 16 in the retracted position while the stopper 25 is rotated to the second position.

When the bin tray 16 is in the retraction start position B, the stopper 25 is in line with the planar portion 26, i.e. in the first position, and lockingly connected thereto since the engaging claws 243 are engaged with the engaging members 261.

As shown in FIG. 14A, the bin tray 16 moves from the position B to the retracted position with the stopper 25 lockingly connected to the planar portion 26. As shown in FIG. 14B, when the bin tray 16 reaches the retracted position, the fifth pins 254 of the bin trays 16 come to contact with contact portions 71*a* of the eccentric cams 71 and thereby the stopper 25 moves in a direction G relative to the planar portion 26. As a result, the claws 253 are disengaged from the engaging members 261.

After the bin tray 16 is stopped in the retracted position, the holder 86 is moved downwards at a specified timing to pressingly hold the copy sheet set placed on the bin tray 16 as described above. At this time, the planar portion 26 is pressed downwards. However, the planar portion 26 is prevented from warping because the stay 73 is in contact with the lower surface of the portion of the planar portion 26 opposing the holder 86. Accordingly, the copy sheets can be pressingly held without warping or shifting from proper positions.

Upon completion of the sheet holding, the cams 71 are rotated clockwise (in a direction H in FIG. 14B) by a specified amount at a specified timing. According to rotation of the cams 71, the fifth pins 254 of the stopper 25 are, as shown in FIG. 14C, caused to slide along the circumferential surface of the cams 71 while moving upwards as the distance from the rotatable shaft 72 to the circumferential surface thereof becomes greater. As a result, the stopper 25 is caused to rotate clockwise about the pins 262, thereby opening up the rear end of the bin tray 16.

On the other hand, when the stopper 25 is brought in line with the planar portion 26, i.e. rotated back to the first position, upon completion of the sheet processing operation, the cams 71 are rotated in the reverse direction by the specified amount. As described above, the stopper 25 is given the rotational force acting in the counterclockwise direction about the pins 262 by the unillustrated biasing device. Accordingly, the stopper 25 is caused to rotated in a direction reverse of the direction H while the fifth pins 254 sliding along the circumferential surface of the cams 71. Rotation of the stopper 25 is stopped when the contact portions 71*a* of the cams 71 come to contact with fifth pins 254 (a state shown in FIG. 14B).

In the foregoing embodiment, the stay 73 of a specified diameter is mounted on the rotatable shafts 72 of the respective eccentric cams 71. The stay 73 is caused to be in contact with the lower surface of the bin tray 16 regardless of whether or not the cams 71 are rotating, thereby preventing the warping of the bin tray 16. However, the stay 73 may be brought to contact with the lower surface of the bin tray 16 in association of the rotation of the cams 71, thereby reinforcing the rigidity of the lower surface of the bin tray 16 to prevent the warping thereof.

Figure 15A:
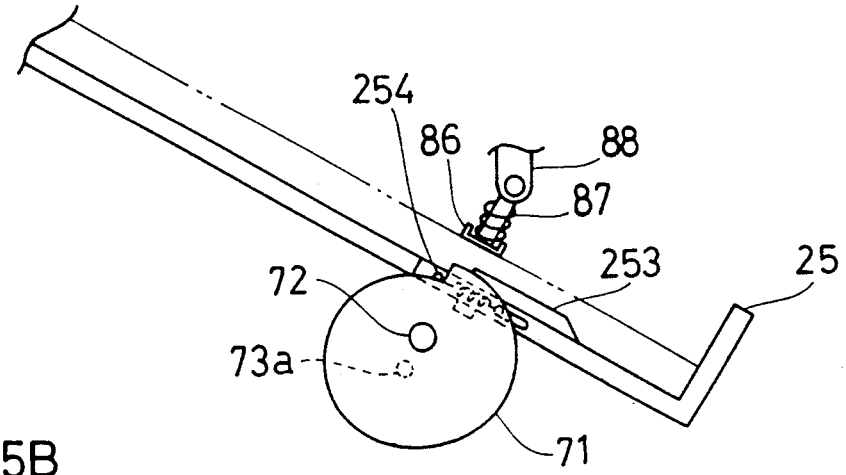
FIGS. 15A and 15B are diagrams showing a warp prevention mechanism for the bin tray.
Figure 15B:
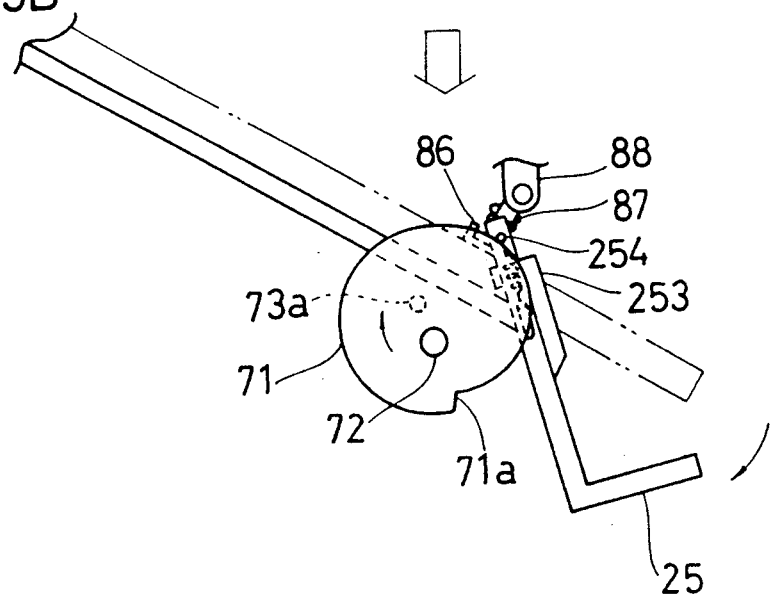

FIGS. 15A and 15B are side views showing another mechanism for preventing the warping of the bin tray 16. In this warp prevention mechanism, as shown in FIG. 15A, a stay 73*a* is provided in parallel with the rotatable shaft 72 with opposite ends thereof connected to specified eccentric positions of the respective cams 71 so as to rotate about the rotatable shaft 72 in association with rotation of the cams 71.

With this warp prevention mechanism, as shown in FIG. 15B, the stay 73*a* is rotatably moved closer to the bin tray 16 according to rotation of the cams 71 in association with rotation of the stopper 25. When the stopper 25 is completely released, i.e. in the second position, the stay 73*a* is in contact with the lower surface of the bin tray 16 so as to prevent the warping of the bin tray 16 resulting from the fact that the copy sheet set are pressed downwards by the holder 86.

A cross-section of the stay 73*a* is not limited to a circle shape, but may be of any desired shape and of any suitable size. For instance, the cross-section of the stay 73*a* may be of an elliptic shape. Particularly, when a stay having a substantially C-shaped cross-section is employed, an outer circumferential thereof can be brought into contact with the lower surface of the bin tray 16 all the time while the stopper 25 is rotated from the first position to the second position. Accordingly, this stay is more effective in preventing the warping of the bin tray 16 than the stay 73*a* in the form of a rod.

Further, the rotatable shaft 72 may be provided with a mount member, and the stay 73*a* may be provided in parallel with and spaced away from the shaft 72 by a specified distance through the mount member.

There will be next described another moving mechanism for the bin tray 16 with reference to FIGS. 16A to 18.

In this moving mechanism, the bin tray 16 is provided with pins 71*b* projecting outwards from opposite sides thereof in place of the engaging members 261, fourth pins 262, projections 252, engaging claws 253, fifth pins 254, and oblong holes 255. The pins 71*b* are pushed by corresponding eccentric cams 71*c*, and thereby the stopper 25 is released. Similarly to the foregoing bin moving mechanism, the stopper 25 is biased in the counterclockwise direction by the biasing device including a helical spring so as not to rotate clockwise due to the weight thereof to open up the rear end of the bin tray 16. Further, in this moving mechanism, the cams 71*c* push the pins 71*b* making use of the circumferential surfaces thereof.

Figure 16A:
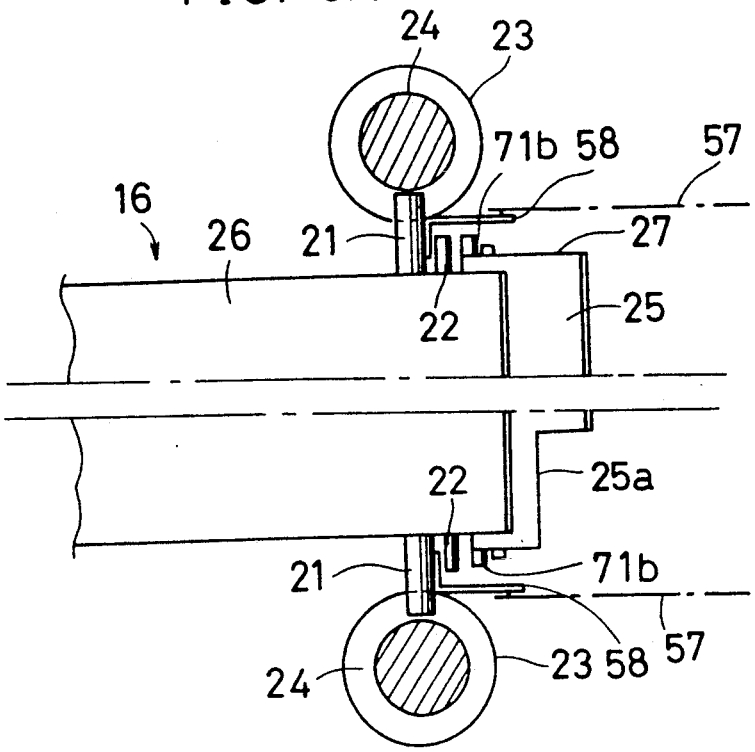
FIG. 16A is a plan view showing an essential portion of another bin tray having a different construction.
Figure 16B:
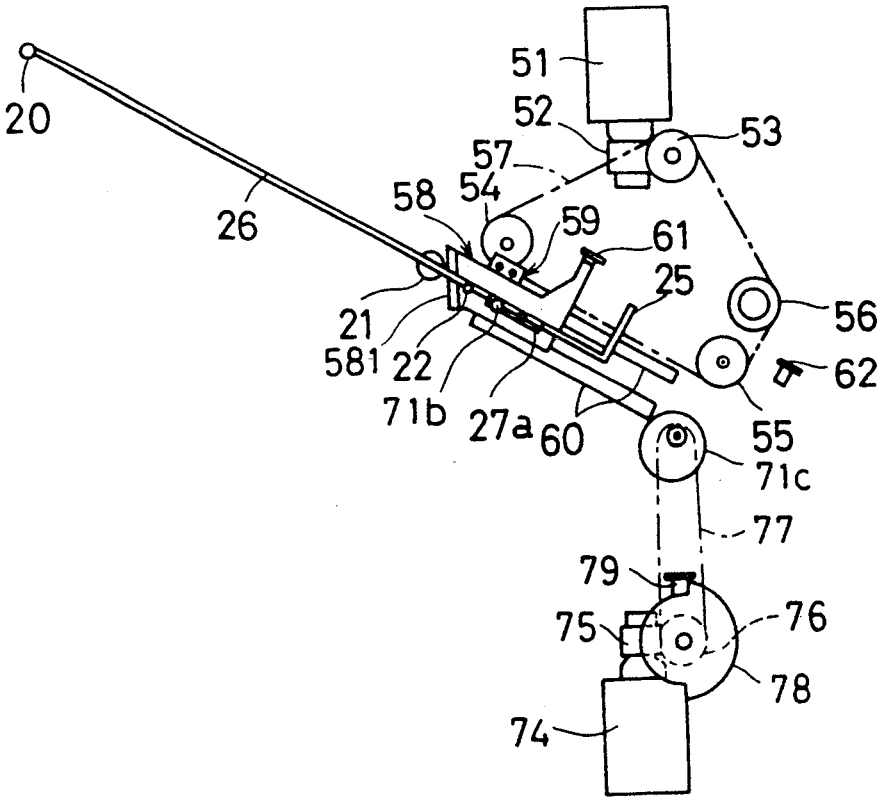
FIG. 16B is a diagram showing a moving mechanism for another bin tray.
Figure 17A:
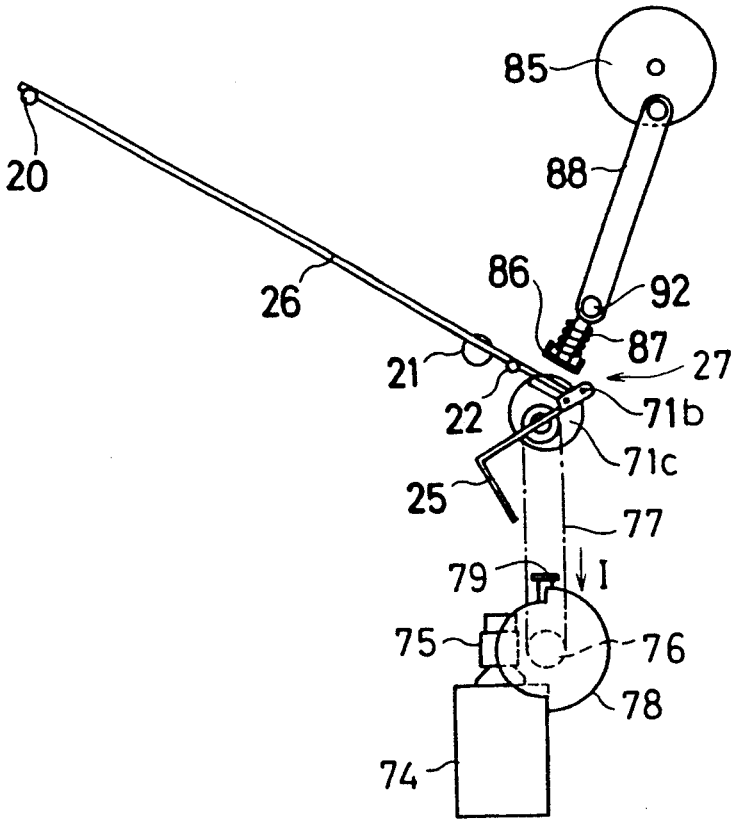
FIG. 17A is a diagram showing a state of another bin tray where a stopper is released.
Figure 17B:
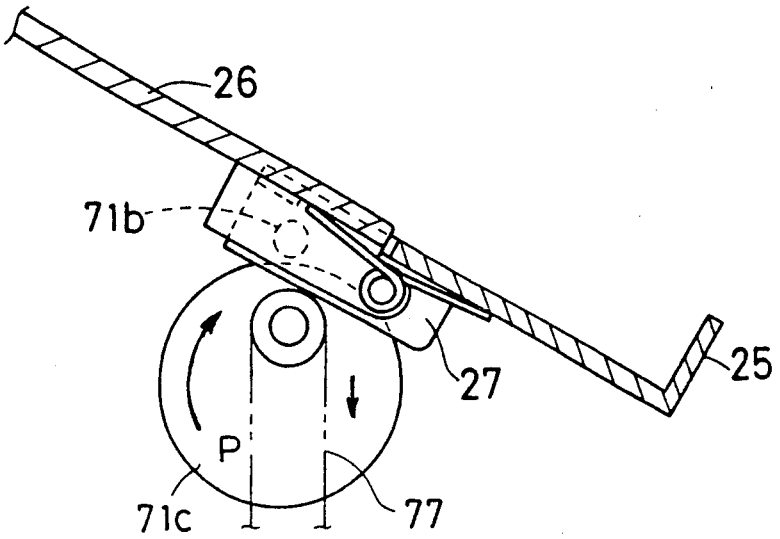
FIGS. 17B and 17C are diagrams showing a stopper releasing operation for another bin tray respectively.

When the bin tray 16 reaches the retracted position shown in FIG. 17A from the retraction start position shown in FIG. 16B, the motor 74 is driven to rotate the sprockets 76 clockwise through the gear 75. Then, the chains 77 rotate in a direction I shown in FIG. 17A, thereby rotating the cams 71*c* clockwise as shown in FIG. 17B. Rotation of the cams 71*c* brings the circumferential surfaces thereof into contact with the corresponding pins 71*b*.

Figure 17C:
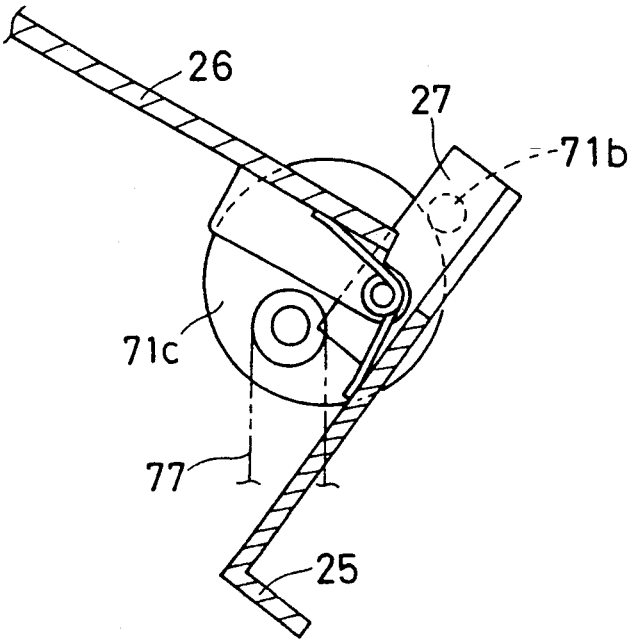

When the cams 71*c* are further rotated to further push the pins 71*b*, the stopper 25 is caused to rotate clockwise against the biasing force given from the springs provided in the connecting portions 27. As a result, the stopper 25 is released as shown in FIG. 17C, enabling a specified processing to be applied to the copy sheet set placed on the bin tray 16.

In the meantime, the rotating amount of the pulse plate 78 is detected by the third sensor 79, and the driving of the motor 74 is stopped in accordance with the sensor signal from the sensor 79 to stop the stopper 25 in a second position.

Figure 18:
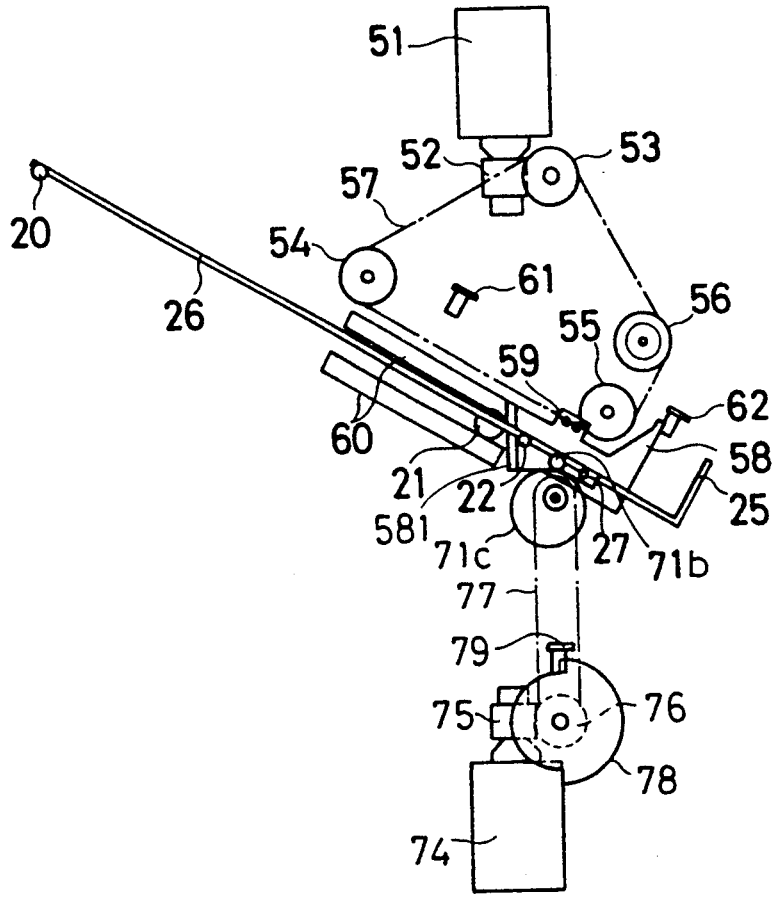
FIG. 18 is a diagram showing a state where another bin tray is in a retracted position thereof.

In the case where the stopper 25 is returned to a first position where it is in line with the planar portion 26, the motor 74 is further driven to rotate the cams 71*c* clockwise by way of the gear 75, sprockets 76, and chains 77. Thereupon, the force pushing the pins 71*b* of the cams 71*c* is reduced and the stopper 25 is returned to the first position upon subjected to the biasing force given from the springs provided in the connecting portions 27 as shown in FIG. 18. It should be noted that the stopper 25 is not to be released in the case where a sheet processing position where the processing is applied to the copy sheet set is located within area defined by the notch 251*a* (hereinafter referred to as a notch defining area).

Hereafter, a construction of the sheet processing device 30 will be described with reference to FIGS. 19 to 22. It will be appreciated that drive mechanisms or the like are omitted from the constructions shown in FIGS. 21 and 22.

The belt 31*b* is stretched horizontally and transversely on the frame 31*a*, and driven by the motor 32.

The support 29 includes a base table 42 and a mount table 44. The base table 42 is fixed to the belt 31*b*, and reciprocally slidable according to rotation of the belt 31*a*, thereby moving the support 29 as a whole in a widthwise direction of the copy sheet set (first drive transmission mechanism).

The mount table 44 is arranged on an upper surface of the base table 42, and moved forwards and backwards at the same angle as the tilting angle of the guide rails 60 with respect to the horizontal direction. The movement of the mount table 44 is translated from the driving force of the motor 43 (second drive transmission mechanism).

Gears 140, 141, 142, and 143 constitutes a drive transmission mechanism for transmitting the torque of the motor 43 to a pulse plate 144. The gears 141 and 142 are mounted on the same shaft, and so arranged that the torque of the motor 43 is boosted while transmitted from the gear 141 to the gear 142. The pulse plate 144 rotates together with the gear 143. A connecting member 146 has one end thereof rotatably mounted to an upper face of the pulse plate 144 at an eccentric position displaced from its center and has the other end thereof rotatably mounted to a lower end of a slider block 145, and thereby connecting the pulse plate 144 with the slider block 145. A cylindrical guide rod 147 is mounted on the base table 42 in such a manner as to form the same inclination with respect to the horizontal direction as the guide rails 60.

Figure 25A:
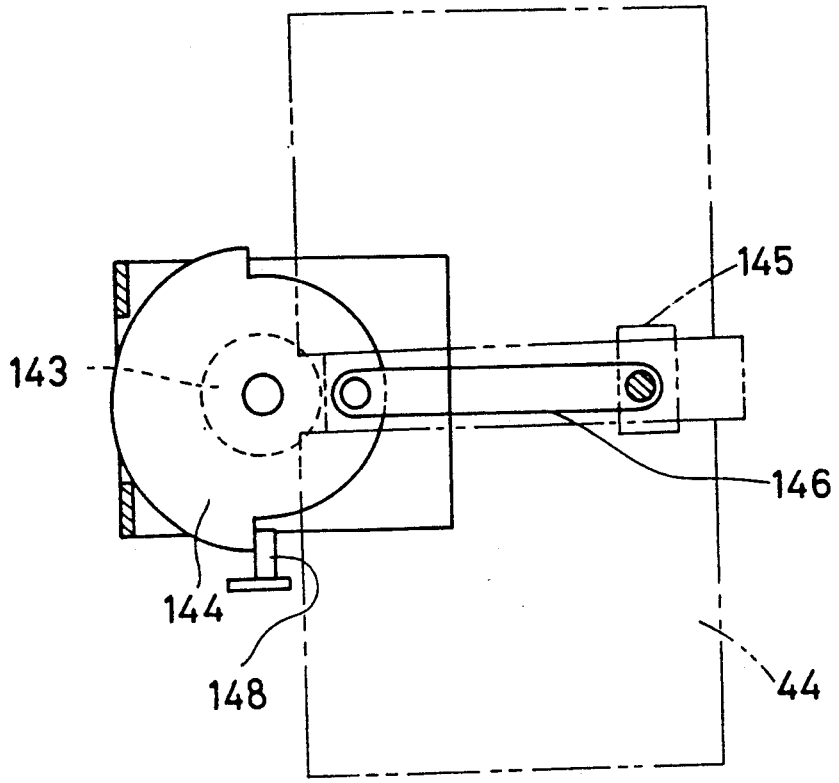
FIGS. 25A and 25B are schematic plan views showing movements of the mount table and pulse plate respectively.
Figure 25B:
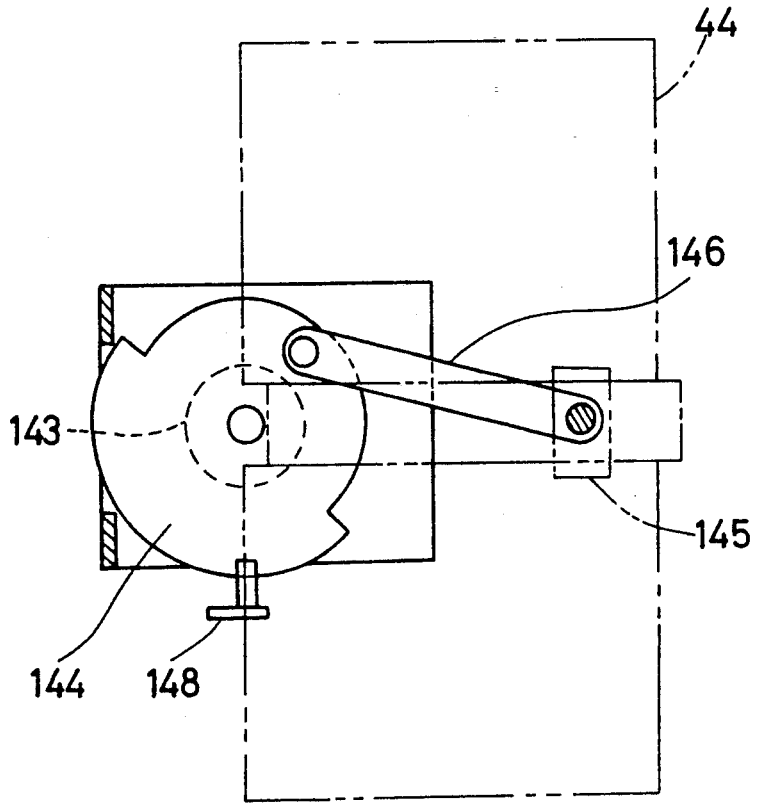

As shown in FIGS. 25B and 25C, the slider block 145 is slidably mounted on the guide rod 147, and reciprocally slides along the guide rod 147 according to the rotation of the pulse plate 144.

Figure 19:
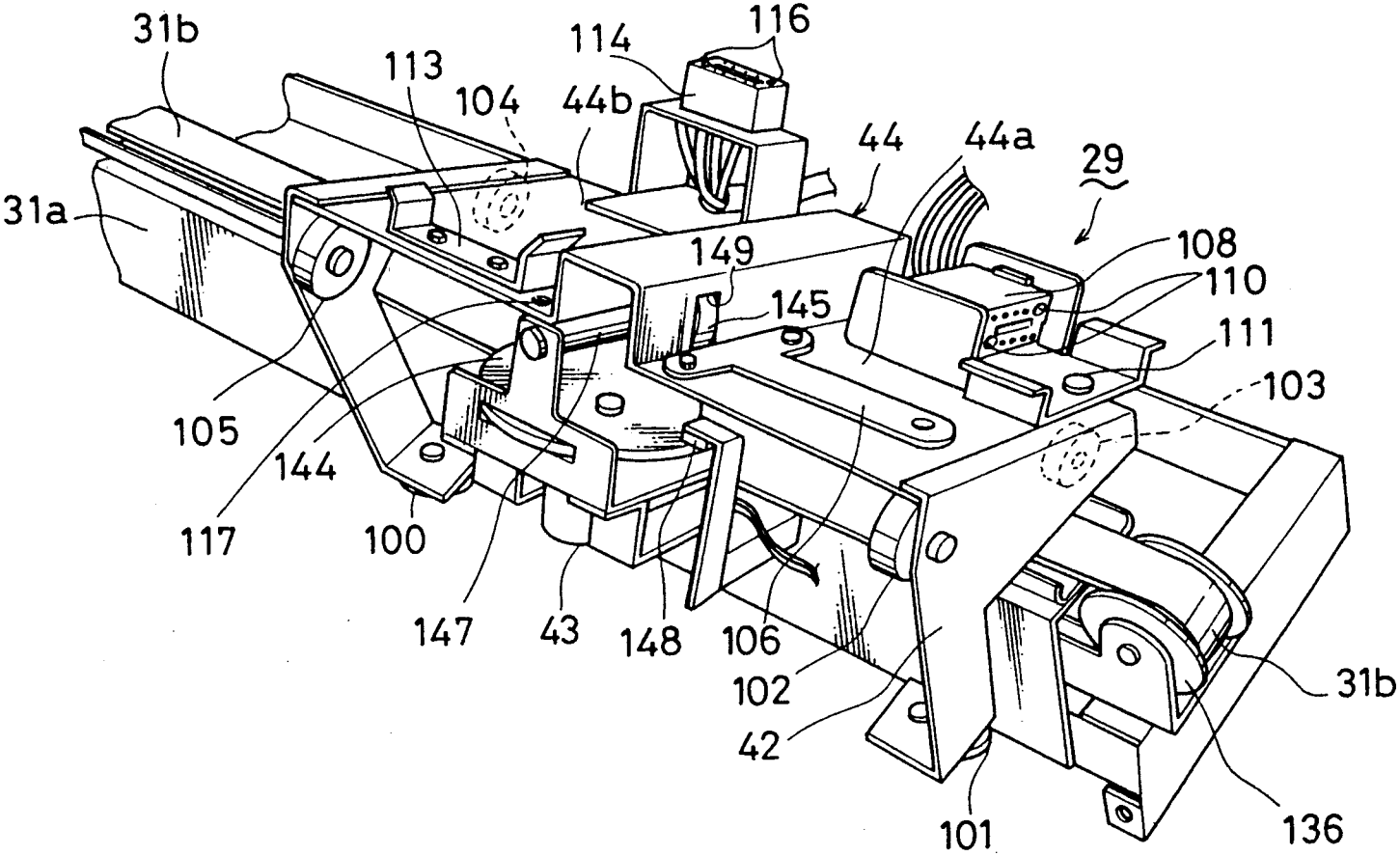
FIG. 19 is a perspective view showing a construction of a sheet processing device with a sheet processor detached therefrom.
Figure 20:
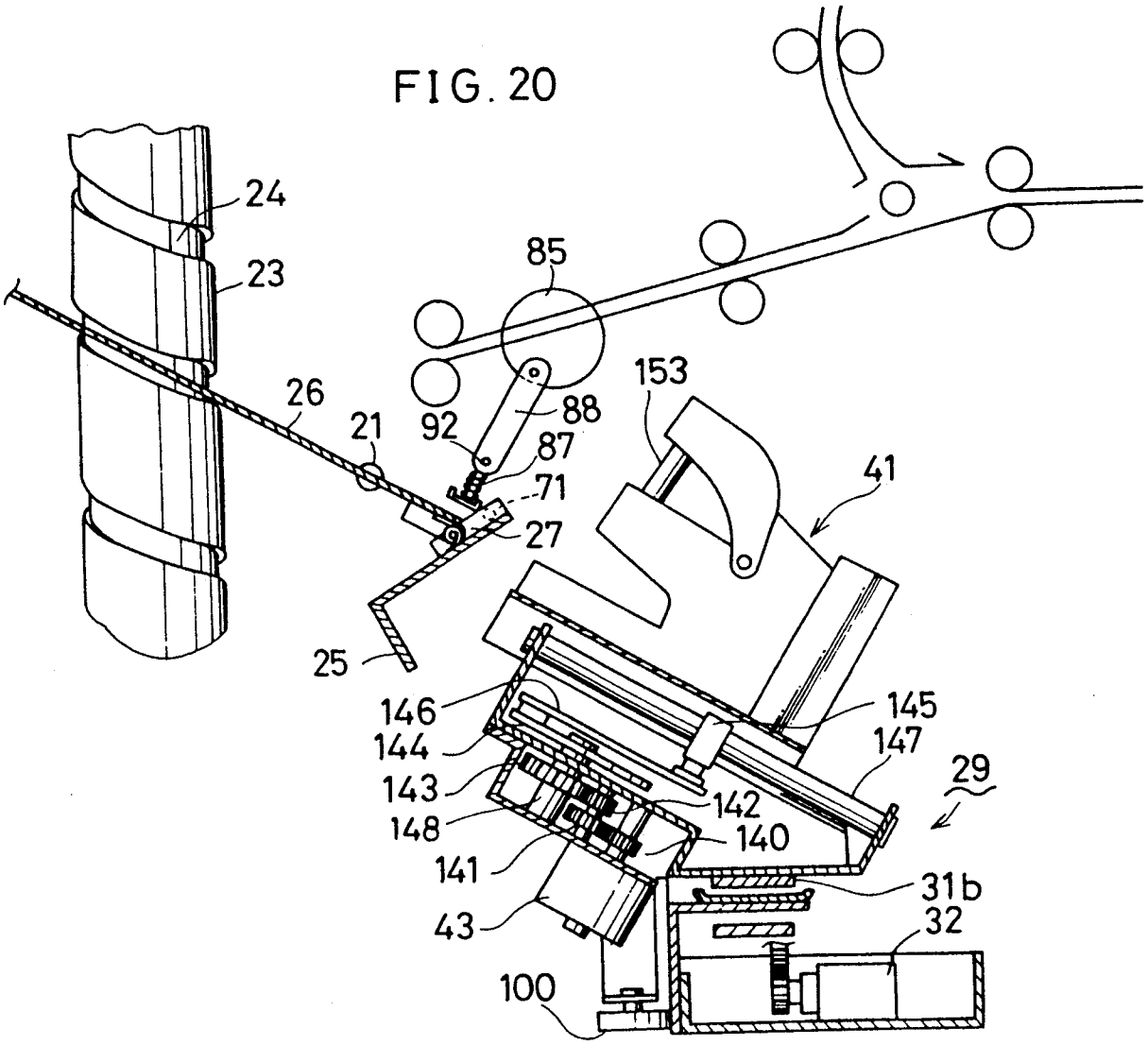
FIG. 20 is an enlarged sectional view showing an operational and positional relationship between the sheet processing device and the bin tray provided in the sorting unit.

As shown in FIG. 19, the mount table 44 is formed with a projecting portion having a U-shaped cross-section opening downward at a center thereof. The mount table 44 is divided by the projecting portion into a first mount portion 44*a* on the right and a second mount portion 44*b* on the left in the drawing of FIG. 19. A notch 149 is defined in each of opposite side walls of the projecting portion in a specified position. The slider block 145 is fitted in the notches 149 defined on the opposite side walls. The sliding of the slider block 145 is translated into movement of the mount table 44 in the lengthwise direction.

A fifth sensor 148, including a photointerrupter or the like, detects a moved mount of the mount table 44 by detecting a rotating amount of the pulse plate 144 rotatable together with the gear 143. The sensor 148 sends a sensor signal representative of the detected moved amount to the control unit 162.

Rollers 100 and 101 are provided to smooth movement of the base table 42 on the frame 31*a*, and rollers 102, 103, 104, and 105 are provided to smooth movement of the mount table 44 on the base table 42.

Figure 21:
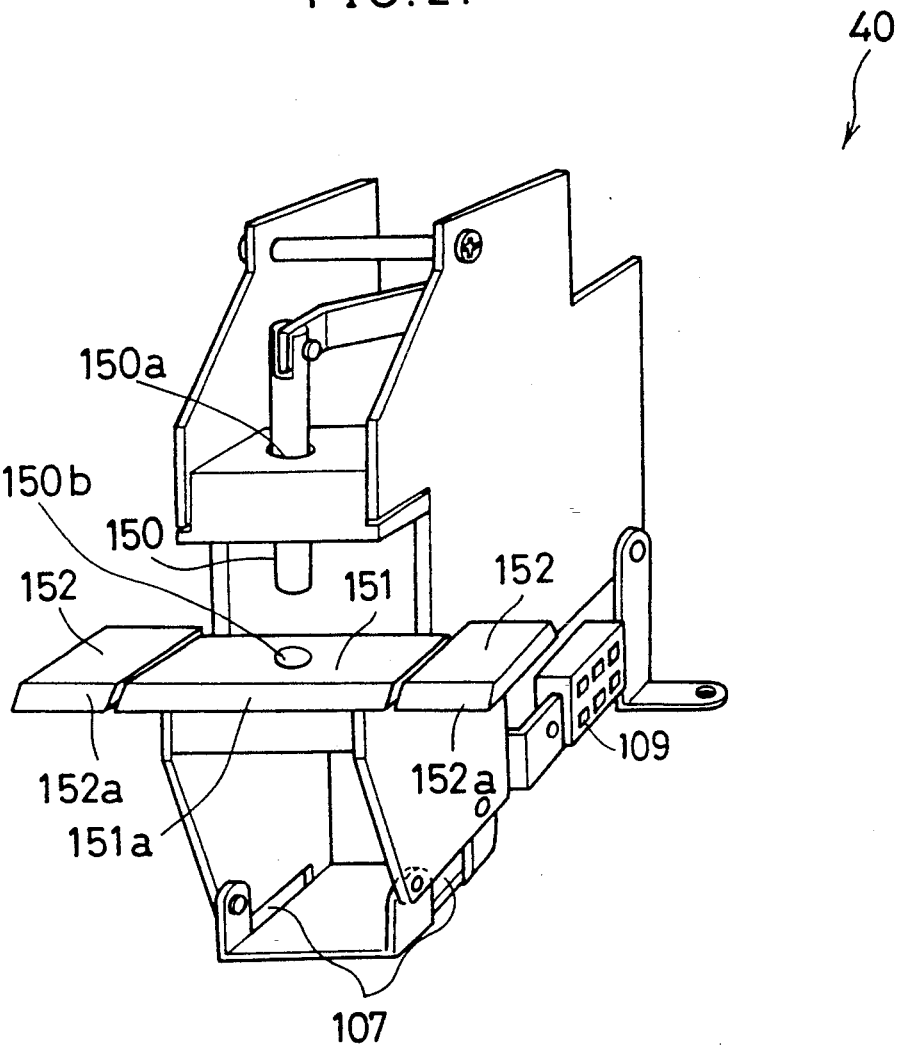
FIG. 21 is a perspective view showing a construction of a punch as an example of the sheet processor.

Hereafter, a mounting arrangement for the punch 40 will be described with reference to FIGS. 19 and 21.

A T-shaped fitting 106 is provided on the first mount portion 44*a*. The fitting 106 has two linear portions, a first portion extending along the projecting portion of the mount table 44 and a second portion extending in perpendicular to the first portion. The T-shaped fitting is screwed onto the mount portion 44*a* at opposite ends of the first portion, and the second portion thereof is inserted through slits 107 defined at a bottom of the punch 40 so as to assist fixation of the punch 40 on the mount table 44. Also, a connector 108 is provided on the first mount portion 44*a* for connecting to the punch 40 signal lines or the like used to control operations of the punch 40. In the connector 108 are formed holes 110 through which pins for securing connection are inserted.

A punch blade 150 of the punch 40 is adapted for making holes in the copy sheets. The copy sheet set is set on a table 151 when to be punched. On opposite sides of the table 151 are provided auxiliary tables 152 for preventing drooping of the sheets. At leading ends of the tables 151, 152 are formed slanting portions 151*a*, 152*a* so as to facilitate setting of the copy sheets. More specifically, the slanting portions 151*a*, 152*a* are, when the leading end portions of the copy sheets to be processed droop upon releasing of the stopper 25, adapted for setting the copy sheets in a specified position while scooping up the same.

When the punch 40 is driven by an unillustrated driving device, the punch blade 150 moves downwards and upwards through the guide hole 150*a*, thereby punching the copy sheets set on the table 151. Paper waste produced by the punching process falls through a punch hole 150*b* below the table 151.

The punch 40 can be completely fixed onto the support 29 by inserting the second portion of the T-shaped fitting 106 through the slits 107, connecting the connector 108 with a connector 109 provided in the punch 40, and screwing the punch 40 onto the support 29 through holes 111, 112. The holes 111, 112 are oblong in a lengthwise direction of the punch 40 so that the punch 40 is adjustable in that direction.

Figure 22:
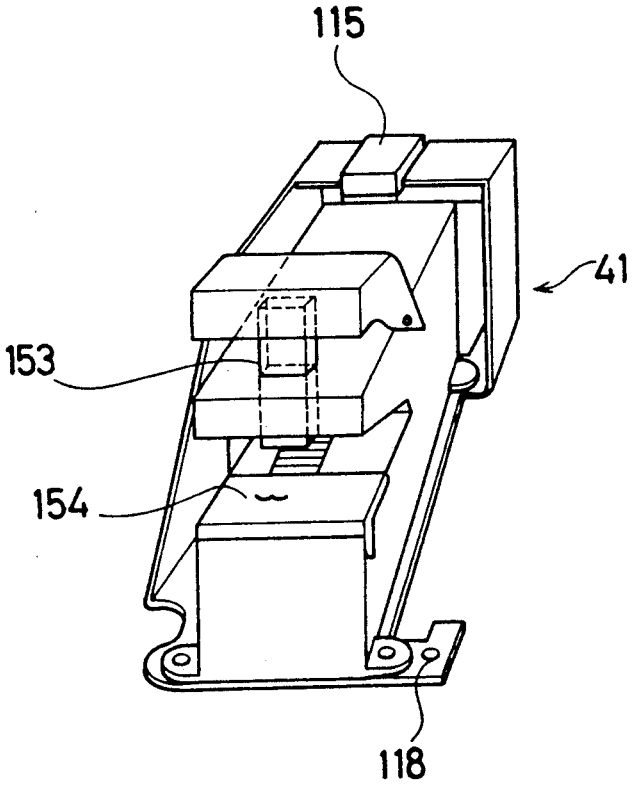
FIG. 22 is a perspective view showing a construction of a stapler as another example of the sheet processor.

Next, a mounting arrangement for a stapler 41 will be described with reference to FIGS. 19 and 22.

A U-shaped fitting 113 is provided on the second mount portion 44*b*. The U-shaped fitting 113 includes a base portion and upright portions extending substantially upwards from opposite ends of the base portion. The base portion of the fitting 113 is disposed in a direction parallel to a stretching direction of the belt 31*b*, and screwed to the mount table 44. The upright portions of the fitting 113 are bent at upper ends thereof. The fitting 113 is adapted for assisting the fixation of the stapler 41. Specifically, the stapler 41 is fitted between the upright portions of the fitting 113, and held therebetween by the springback of the upright portions. A connector 114 is adapted for connecting to the stapler 41 signal lines or the like used to control operations of the stapler 41. In the connector 114 are formed holes 116 through which pins for securing connection are inserted.

The stapler 41 binds a set of sheets with a staple. When to be stapled, the sheets are set on a base 154. Similarly to the normal stapler, a stapling portion 153 is caused to descend suddenly whereby to insert opposite leading ends of the staple into the sheets. Upon reaching an anvil defined on the base 154, the opposite leading end portions of the staple are bent, and thereby the sheets are bound.

The stapler 41 requires no auxiliary table when the stapling is applied to the copy sheets at a position located within the notch 251*a* since the stopper 25 is not released. Even in the case where the stapling is applied to the copy sheets at a position located outside the notch 251*a* with the stopper 25 released, the stapler 41 requires neither an auxiliary table nor slanting portions as described above since the tables 151 and 152 of the punch 40 serve as an auxiliary table for the stapler 41 and the drooped copy sheets are scooped up by the slanting portions 151*a*, 152*a* of the tables 151, 152. In accordance with the invention, it is sufficient to provide an auxiliary table and a slanting portion in at least either one of the punch 40 and stapler 41.

The stapler 41 can be completely fixed onto the second mount portion 44*b* by being fitted between the upright portions of the fitting 113 by the springback of the upright portions, connecting the connector 114 with a connector 115 provided in the stapler 41, and screwed the stapler 41 onto the mount portion 44*b* through holes 117, 118.

In this way, the sheet processor 28 such as the punch 40 and stapler 41 is made detachably mountable to the support 29.

Figure 23:
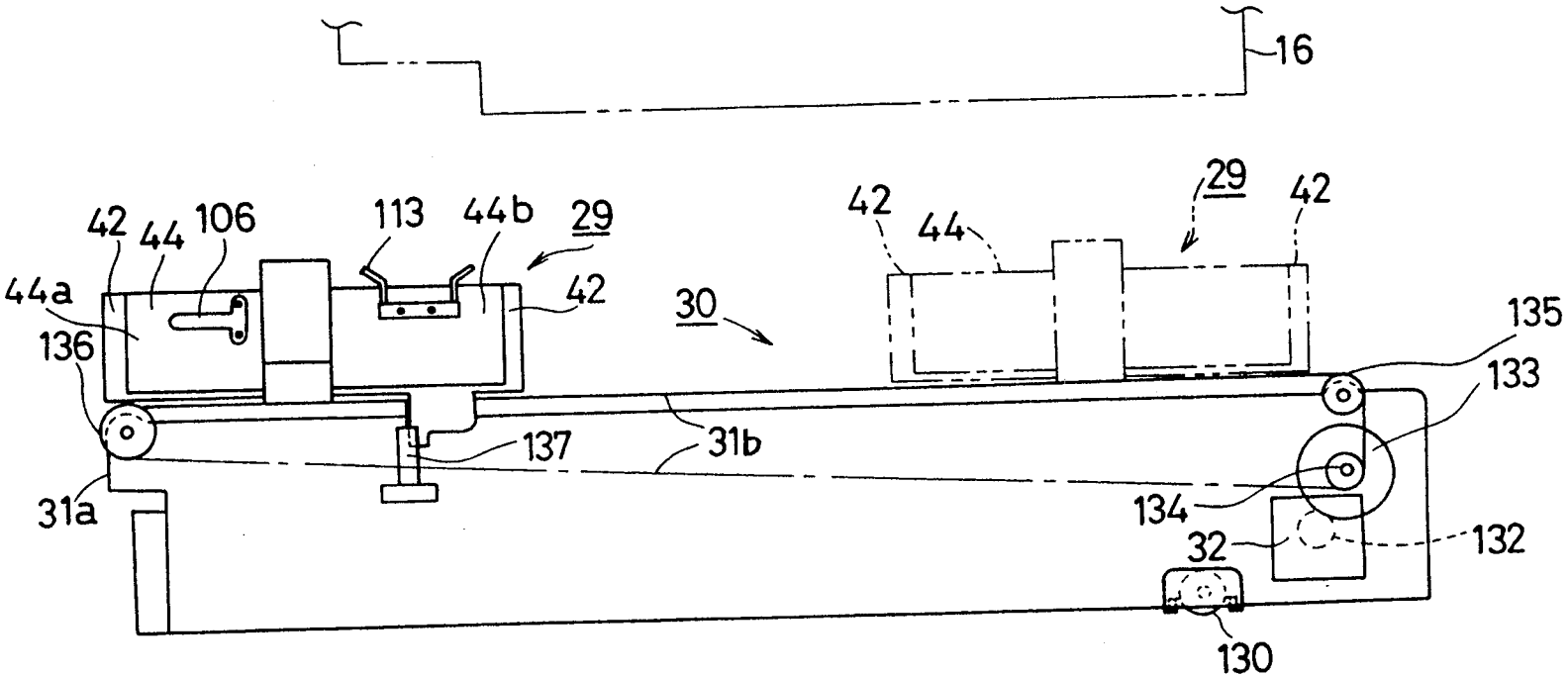
FIG. 23 is an elevational view seen from an arrow direction A in FIG. 1, showing a widthwise movement of the support.
Figure 24:
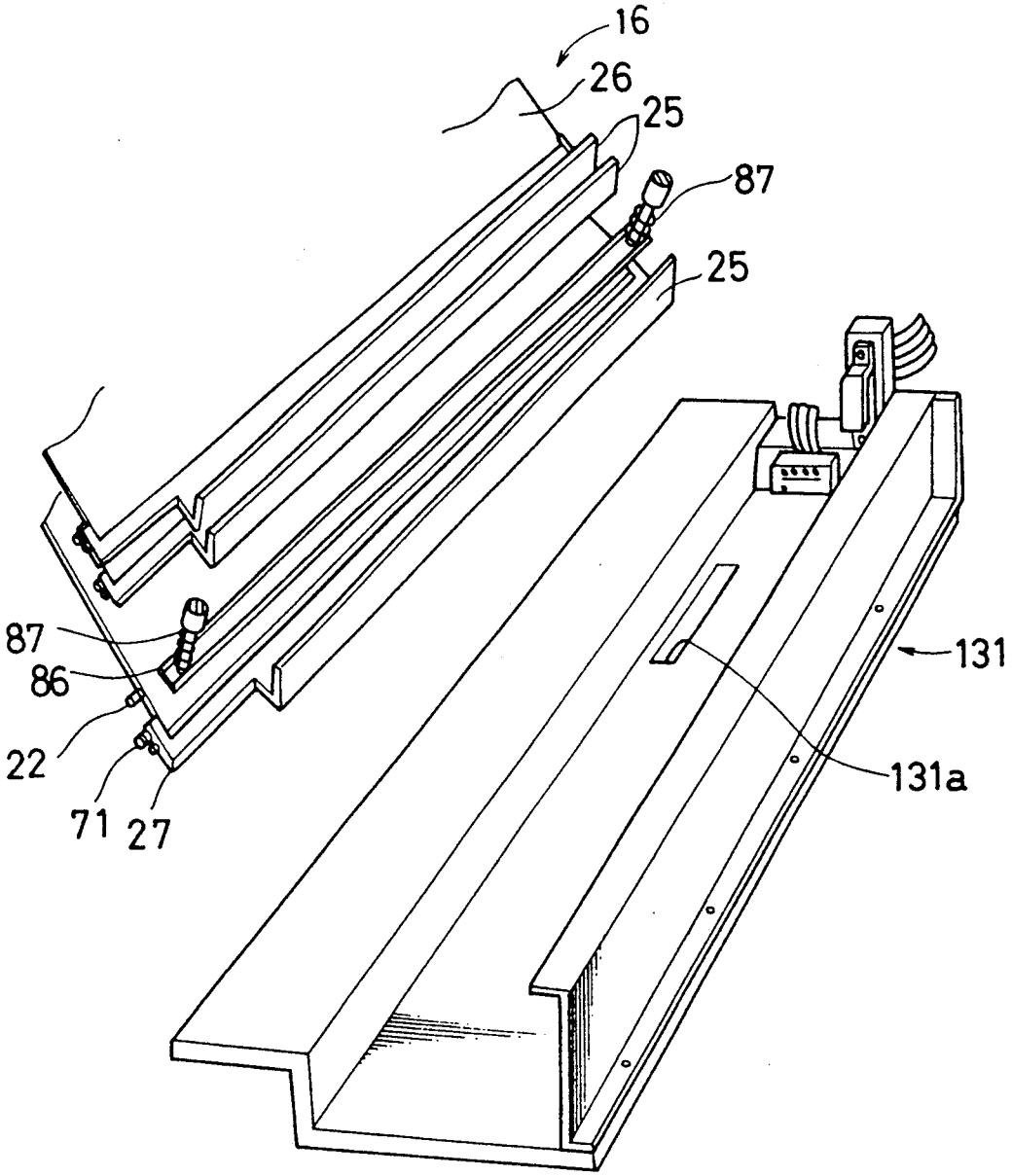
FIG. 24 is a perspective view showing a mount member for mounting the sheet processing device on the sorting unit.

Next, a construction of the frame 31*a* of the sheet processing device 30 will be described with reference to FIGS. 19, 23, and 24.

The frame 31*a* is formed box-shaped, and provided internally with a drive transmission mechanism including the motor 32, gears 132, 133, pulleys 134, 135, 136, and belt 31*b*. The base table 42 of the support 29 is fixedly connected to the belt 31*b*.

The torque of the motor 32 is transmitted to the pulley 134 rotatable together with the gear 133 through the gear 132, and thereby the belt 31*b* is rotated.

Also, a roller 130 is provided in a specified position at a bottom of the frame 31*a*. As shown in FIG. 24, a slot 131*a* is defined in a mount member 131 for mounting the sheet processing device 30 in the sorting unit 14. The mount member 131 is mounted in a specified position in the sorting unit 14. When the sheet processing device 30 is mounted in the sorting unit 14 through the mount member 131, the roller 130 is engageable with the slot 131*a*.

At a bottom of the base table 42 is provided a sixth sensor 137. The sensor 137, including a photointerrupter or the like, detects whether the base table 42 is in a home position and sends a sensor signal representative of the detection result to the control unit 162. The home position is located closer to a door 14*a* provided at a side wall of the sorting unit 14 (at the left side in FIG. 23), and indicated by solid line in FIG. 23. When the stapling is applied to the copy sheet at the position located within the notch 251*a*, the base table 42 stays in the home position.

The frame 31*a* is formed such that a left end portion thereof projects toward the door 14*a* from the left side end of the bin tray 16 approximately by half the width of the mount table 44 of the support 29. Therefore, a mounting operation, maintenance, and inspection of the punch 40 located on the first mount portion 44*a* can be easily done just by opening the door 14*a*.

In the foregoing embodiment, the punch 40 is mounted on the first mount portion 44*a* which is closer to the door 14*a* and the stapler 41 is mounted on the second mount portion 44*b* which is farther from the door 14*a*. These sheet processors are arranged in this manner for the following reasons. Generally, stapling is a more frequently required sheet processing operation than punching. Accordingly, it may be better to detach the punch 40 when not necessary in order to reduce the burden on the motor 32 for driving the support 29. As a result, the punch 40 is mounted and detached more frequently than the stapler 41. In view of this, the punch 40 is mounted on the first mount portion 44*a* closer to the door 14*a*. Also, the punching is applied to a center portion of the sheets while the stapling is applied at opposite end corners of the sheets. Accordingly, the stapler 41 is mounted on the second mount portion 44*b* farther from the door 14*a* so that it can reach a farthest possible position from the door 14*a*.

This enables a moving range of the base table 42 to be shortened without adversely affecting the punching operation which is carried out in a range narrower than the widthwise dimension of the sheets.

Further, when the frame 31*a* is withdrawn from the sorting unit 14, the roller 130 comes into contact with a left edge face of the slot 131*a*, i.e. an edge face which is located closer to the door 14*a*, and stops thereat. The positional relationship between the roller 130 and slot 131*a* is such that, when the frame 31*a* is withdrawn toward the door 14*a* in a state where the base table 42 is in the home position (i.e., a state indicated by solid line in FIG. 23), the support 29 temporarily stays in a position where maintenance and inspection can be carried out for the stapler 41 mounted on the second mount portion 44*b* without being interfered by the presence of the bin tray 16.

When the frame 31*a* is further withdrawn, the left side portion thereof is slightly pressed downward to disengage the roller 130 from the slot 131*a*. After got out of the slot 131*a*, the roller 130 smoothly rotates on an upper surface of the mount member 131, thereby facilitating withdrawal of the frame 31*a*. In this way, the sheet processing device 30 can be easily mounted and detached to and from the sorting unit 14.

Next, there will be described movements of the base table 42 and mount table 44 with reference to FIGS. 19, 20, 25A, and 25B.

Firstly, movement of the base table 42 will be described.

Upon rotating the motor 32 in one direction, the torque thereof is transmitted to the pulley 134 through the gears 132, 133, and thereby the pulley 134 starts rotating. Thereupon, the belt 31 starts rotating to move the base table 42 in the widthwise direction of the pressingly held copy sheet set. A moving distance of the base table 42 is controlled by the control unit 162 based on an energization period of the motor 32 which is measured using the home position or the like as a reference point, and a number of drive pulses sent to the motor 32.

When the base table 42 is to be returned to the home position, the motor 32 is rotated in the reverse direction. Upon the sixth sensor 137 detecting the presence of the base table 42, the control unit 162 stops the driving of the motor 32.

Next, movement of the mount table 44 will be described.

Upon rotating the motor 43 in one direction, the torque thereof is transmitted to the pulse plate 144 through the gears 140, 141, 142, and 143, and thereby the pulse plate 144 starts rotating. The rotation of the pulse plate 144 is translated into movement of the slider block 145 in the lengthwise direction through the connecting member 146. Together with the connecting member 146, the mount table 44 moves toward the copy sheet set.

The rotating amount of the pulse plate 144 is detected by the fifth sensor 148. Upon the mount table 44 reaching a specified position, the control unit 162 stops the driving of the motor 43. In the specified position, the copy sheet set is set on the table 151 and auxiliary tables 152 of the punch 40, or on the base 154 of the stapler 41.

When the mount table 44 is to be returned to its original position, the motor 43 is driven to further rotate the pulse plate 144 in the same direction. When the fifth sensor 148 detects that the mount table 44 has returned to the original position, the control unit 162 stops the driving of the motor 43.

Figure 26:
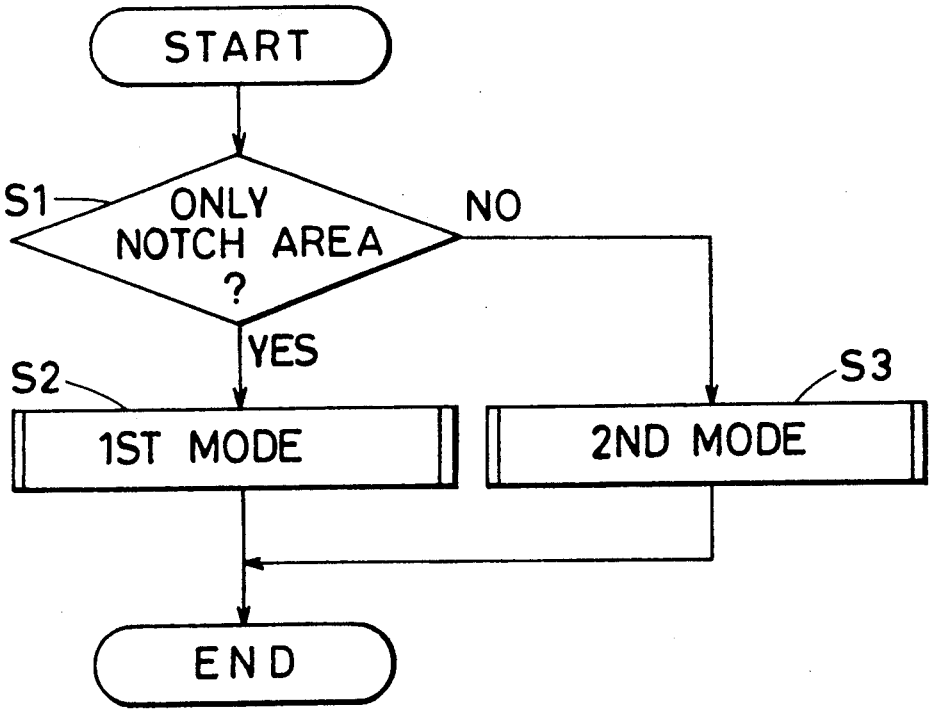
FIG. 26 is a flow chart showing a main routine of a sheet processing operation.
Figure 27:
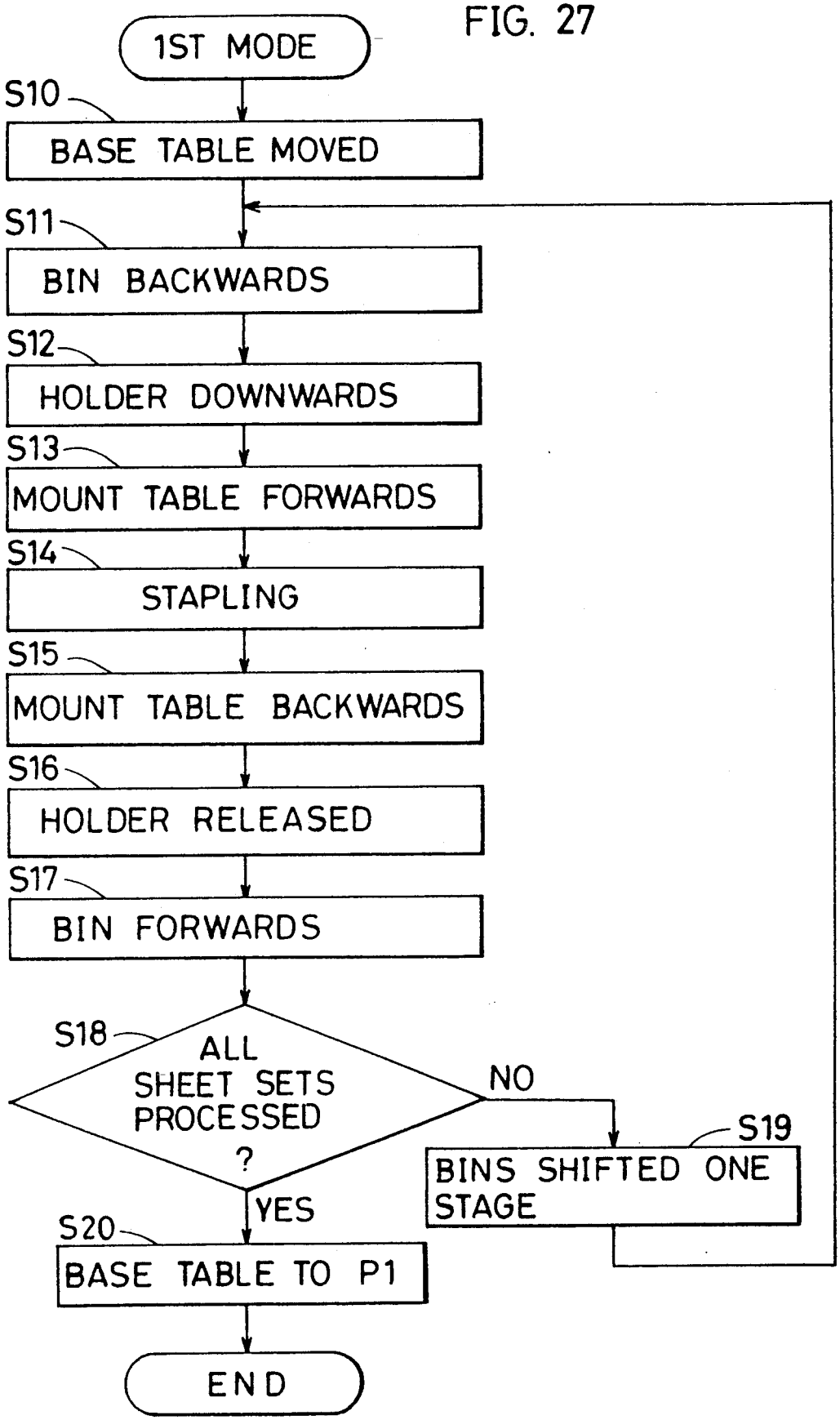
FIG. 27 is a flow chart showing an operation procedure of a first mode where sheet processing is applied to a set of sheets only in an area defined by a notch formed in the bin tray.
Figure 28:
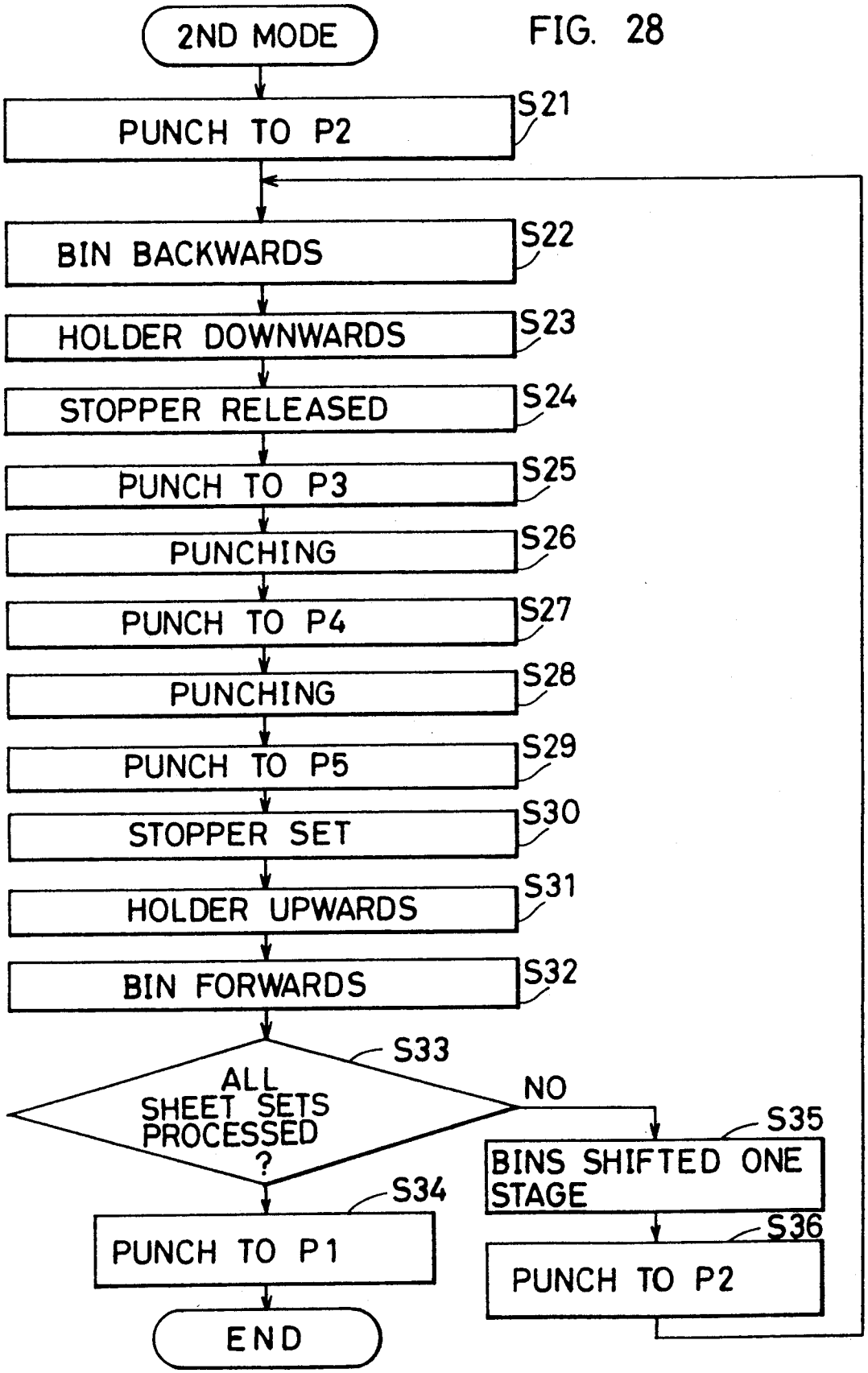
FIG. 28 is a flow chart showing an operation procedure of a second mode wherein, for example, sheet processing is applied to a rear end portion of a set of sheets in two positions spaced apart in a widthwise direction of the sheet symmetrically with respect to a center in the width of the sheet.

Next, the sheet processing operations will be described with reference to FIGS. 26 to 28. FIG. 26 is a flow chart showing a main routine of the sheet processing operation.

When the positions where the processing is applied to the set of copy sheets, i.e. processing positions, and the type of processing are selected by means of the selection key 13, the sheet processing operations start. It should be understood that the processing positions are written in a plural form hereafter though the processing may be applied at a single position.

Firstly, it is discriminated in Step S1 whether the processing is required to be executed for only the notch defining area. In the case where the processing is required to be executed for only the notch defining area (YES in Step S1), the main routine proceeds to Step S2 in which a first mode is executed.

On the other hand, in the case where at least one of the processing positions is located outside the notch defining area (NO in Step S1), the main routine proceeds to Step S3 in which a second mode is executed.

First, the operations of the first mode will be described with reference to FIG. 27. In the first mode, the processing is applied to the rear end portion of the set of copy sheets within the notch defining area. In this operation, stapling is applied to the copy sheet set in a single position as an example of processing.

Firstly, the motor 32 is driven to move the base table 42 up to a position where the stapler 41 opposes the processing position in Step S10. Subsequently, the motor 51 is driven to move the bin tray 16 bearing the copy sheet set to be processed thereon backwards toward the stapler 41 in Step S11. Upon the second sensor 62 detecting the presence of the bin tray 16 in the retracted position, the motor 51 is deenergized and the motor 81 is driven to move the holder 86 downwards so as to pressingly hold the copy sheet set in Step S12.

Thereafter, the motor 43 is driven to move the mount table 44 forwards up to the processing position and deenergized to cause the mount table 44 to stop thereat, and the copy sheet set is set on the base 154 of the stapler 41 in Step S13. In the first mode, it is not required to release the stopper 25 since the processing is applied to the copy sheet set within the notch defining area. In Step S14, the stapler 41 is actuated, and thereby binding the copy sheet set with a staple.

Upon completion of the stapling operation, the motor 43 is driven further in the same direction to move the mount table 44 backwards to the original position, moving the stapler 41 away from the copy sheet set in Step S15. Subsequently, the motor 81 is further driven in the same direction to release the holder 86 in Step S16. In Step S17, the motor 51 is driven in the reverse direction to move the bin tray 16 forwards, and deenergized upon the first sensor 61 detecting the presence of the bin tray 16 in the original position.

Next, in Step S18, it is discriminated whether the stapling has been applied to all the sets of copy sheets placed on the bin trays 16. Unless all the sets of copy sheets have been processed (NO in Step S18), the motor 230 is driven to shift the stack of bin trays 16 upwards or downwards by one stage in Step S19. At this time, the stack of bin trays 16 are shifted downwards by one stage in the case where the stapling is started from the bottommost bin tray 16, while shifted upwards by one stage in the other case. The operations executed in Steps S11 to S18 are directed to the bin tray 16 shifted to the operative position.

On the other hand, all the sets of copy sheets have been processed (YES in Step S18), the motor 32 is driven in the reverse direction to bring the base table 42 back to the home position in Step 20 and the sheet processing operation ends.

If the processing position is a position opposing the home position, no operation is required in Steps S10 and S20. This is because movement of the base table 42 is not necessary. Although the operation of the flow chart of FIG. 27 is described with reference to stapling, it is needless to say that punching may be executed in accordance with this flow chart.

Figure 29:
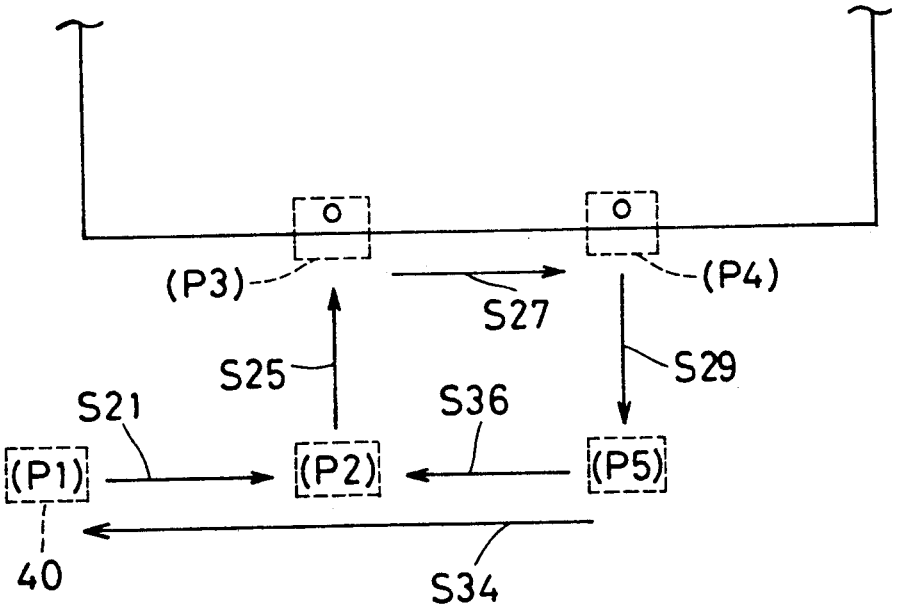
FIG. 29 is a diagram showing a moving course of the punch and punching positions.

Next, operations of the second mode will be described with reference to FIG. 28. In the second mode, the processing is applied to two portions of the rear end portion of the set of copy sheets. In this operation, the punching is applied to the copy sheet set as an example of the processing. FIG. 29 is a diagram showing a relation between the movement and stop positions of the punch 40 and punching positions of the copy sheet.

Firstly, in Step S21, the motor 32 is driven to move the base table 42 in the widthwise direction of the sheet to move the punch 40 from the home position P1 to a position P2 opposing a first punching position P3, and is deenergized to stop the punch 40 thereat. Subsequently, the motor 51 is driven to move the bin tray 16 bearing the set of copy sheets to be processed thereon to the retracted position in Step S22. Thereafter, the motor 81 is driven to cause the holder 86 to pressingly hold the copy sheet set in Step S23. Thereupon, the motor 74 is driven to release the stopper 25 of the bin tray 16 in Step S24. It will be appreciated that, pressingly held already in Step S23, the copy sheet set is not to droop even if the stopper 25 is released.

Next, the motor 43 is driven to move the mount table 44 forwards to the processing position P3, and the copy sheet set then comes over the table 141 and auxiliary table 152 of the punch 40 in Step S25. In Step S26, the punch 40 is actuated to make a hole in the copy sheet set. Upon completion of the punching operation at the first punching position P3, the motor 32 is driven to move the punch 40 further in the widthwise direction to a second punching position P4, and deenergized to stop the punch 40 thereat in Step S27. Subsequently, the punch 40 is actuated to make a hole in the copy sheet set in Step S28. Upon completion of the punching operation at the second punching position P4, the motor 43 is driven further in the same direction to move the mount table 44 backwards up to a position P5, moving away from the copy sheet set in Step S29.

Subsequently, the motor 74 is further driven in the same direction to return the stopper 25 from the released position to the stopping position in Step S30. In Step S31, the motor 81 is further driven in the same direction to release the holder 86. Then, the motor 51 is driven in the reverse direction to return the bin tray 16 bearing the processed copy sheet set to the original position in Step S32.

Thereafter, it is discriminated whether the punching has been applied to all the sets of copy sheets placed on the bin trays 16 in Step S33. Unless all the sets of copy sheets have been processed (NO in Step S33), the motor 230 is driven to shift a stack of bin trays 16 upwards or downwards by one stage in Step S35.

In Step S36, the motor 32 is driven in the reverse direction to move the punch 40 from the position P5 to the position P2, and deenergized to cause the punch 40 to stop thereat. Then, this routine returns to Step S22 and operations executed in Steps S22 to S33 are directed to a copy sheet set placed on the bin tray 16 just shifted to the operative position.

On the other hand, all the sets of copy sheets have been processed (YES in Step S33), the motor 32 is driven in the reverse direction to bring the punch 40 back to the home position P1 in Step S34 and the sheet processing operation ends.

It will be appreciated that a course of movement of the punch 40 is not limited to the one shown in FIG. 29 according to the invention. More specifically, the punch 40 may be paused at the position P5 without returning to the position P2 in Step S36. For the next set of copy sheets, the punching is applied first at the second processing position P4 and then at the first processing position P3. Thereafter, the punch 40 is moved backwards to the position P2. In this way, it is also possible to alternately change a sequence of punching at the first processing position P3 and second processing position P4 each time a new set of copy sheets is set in the operative position.

In this embodiment, the second mode is described with respect to a case where punching is applied as a mechanical processing. However, stapling may be applied in place of punching in the second mode by executing the similar control. Since the stapler 41 and punch 40 are mounted on the support 29 side by side along the moving direction of the support 29, the home positions thereof are different. Accordingly, the distance between the home positions of the stapler 41 and punch 40 in the moving direction of the support 29 should be taken into account in controlling the position of the stapler 41.

Further, in this embodiment, the second mode is described with respect to a case where the processing is applied to two positions of each set of copy sheets. However, it should be understood that the sheet processing operation of the invention can be controlled similarly to the above embodiment even if the processing is to be applied to three or more positions of each set of copy sheets. In addition, the processing can be applied to any desired position of each set of copy sheets. It is also possible to set the home position of the support 29 near the rear wall of the sorting unit 14 opposing the wall having the door 14*a*. In this case, another door may be provided on that side wall so as to facilitate maintenance, inspection, and like operation for the sheet processors.

Further, in the foregoing embodiment, the punch 40 and stapler 41 are used as exemplary sheet processors 28. However, in accordance with the invention, the sheet processors 28 are not limited to those. Any device including a printer may be a sheet processor, provided that it applies a processing to a sheet or set of sheets.

Moreover, in the foregoing embodiments, the motor 43 for moving the sheet processor 28 to the processing position is controlled based on the detection result of the pulse plate 144 and fifth sensor 148. However, a way of controlling movement of the sheet processor 28 is not limited to this. For instance, a sheet sensor switch for detecting the presence of the sheet(s) may be provided in the vicinity of a portion of the sheet processor 28 where the actual processing is carried out. The sensor switch sends an ON-signal or OFF signal based on the detection result. The motor 43 is on-off controlled in accordance with the signal from the sensor switch, so as to set the sheet processor 28 in the proper processing position. Provision of the sensor switch is advantageous in preventing an idle operation of the sheet processor 28. This is because, in the case where the sheets are taken out of the bin trays 16 during an intermediate time between the sorting operation and sheet processing, the sensor switch is kept in the OFF state and therefore the sheet processing operation is not to be started.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A sorter comprising:

a plurality of bin trays arranged in a vertical direction, each bin tray having a specified width and length and adapted for bearing a sheet;

shifting means for shifting the plurality of bin trays in the vertical direction; and moving means for moving a bin tray at a predetermined position in said sorter, in a lengthwise direction of the respective bin tray;

said moving means including disengaging means for disengaging the bin tray from the shifting means;

said shifting means including:

a pair of rotatable upstanding cylinders arranged on opposite sides of the plurality of bin trays, each cylinder having a guide surface extending spirally on a surface of the cylinder;

a pair of pins projecting horizontally from opposite sides of each bin tray and slidable on the guide surface and disengagable therefrom at said position; and driving means for rotating the pair of cylinders;

whereby the pins slide on the guide surface in response to rotation of the cylinders so as to shift the plurality of bin trays in the vertical direction.

2. A sorter as defined in claim 1 further comprising a sheet processing device for applying sheet processing to the sheet at a predetermined portion, wherein the moving means moves the bin tray to a position where the sheet processing device applied sheet processing to the sheet on the bin tray.

3. A sorter as defined in claim 2 wherein the sheet processing device includes a mount member, a sheet processor detachably mountable on the mount member, and a moving mechanism for moving the mount member in the lengthwise of the bin tray.

4. A sorter as defined in claim 1 further comprising restricting means for preventing the plurality of bin trays from getting off the shifting means while the plurality of bin trays are being shifted.

5. A sorter as defined in claim 1 wherein the moving means includes a guide member having a slide surface inclined at an angle greater than the inclination of the spiral guide surface with respect to an axial direction of the cylinders, and the spiral guide surface is formed with a flank having the same inclination as the slide surface and coming in alignment with the slide surface for each turn of the cylinders.

6. A sorter as defined in claim 1 wherein the shifting means further includes detector means for detecting the rotating amount of the cylinders, and controller means responsive to the detector means for controlling the driving means so that a desired one of the plurality of bin trays reaches the predetermined position.

7. A sorter as defined in claim 6 wherein the detector means includes a pulse plate and sensor.

8. A sorter as defined in claim 6 wherein the controller means includes first memory means for storing a stopping position at which the cylinders are stopped, second memory means for storing a braking position at which application of braking force to the cylinders is started, discriminator means for discriminating whether the cylinders are stopped at the stopping position, and a controlling portion responsive to the discriminator means for controlling the driving means so as to rotate the cylinders to the stopping position.

9. A sorter as defined in claim 8 wherein the controlling portion controls the driving means so as to rotate the cylinders slower after the application of braking force than before the application of braking force.

10. A sorter as defined in claim 1 wherein the pins of the bin trays are each provided with a roller rollable on the guide surface.

* * * * *